US009789993B2

(12) United States Patent
Smith et al.

(10) Patent No.: US 9,789,993 B2
(45) Date of Patent: Oct. 17, 2017

(54) FOLDED-CAP CONTAINERS AND METHOD FOR MAKING SAME

(71) Applicant: WestRock Shared Services, LLC, Norcross, GA (US)

(72) Inventors: Kenneth C. Smith, Hiram, GA (US); Joel Cram, Ooltewah, TN (US); Eric Vasbinder, Mableton, GA (US)

(73) Assignee: WestRock Shared Services, LLC, Norcross, GA (US)

( * ) Notice: Subject to any disclaimer, the term of this patent is extended or adjusted under 35 U.S.C. 154(b) by 0 days.

(21) Appl. No.: 14/706,382

(22) Filed: May 7, 2015

(65) Prior Publication Data

US 2015/0321785 A1 Nov. 12, 2015

Related U.S. Application Data

(60) Provisional application No. 61/990,398, filed on May 8, 2014.

(51) Int. Cl.

| | |
|---|---|
| ***B65D 5/02*** | (2006.01) |
| ***B65D 5/14*** | (2006.01) |
| ***B31B 1/26*** | (2006.01) |
| ***B31B 17/00*** | (2006.01) |

(52) U.S. Cl.

CPC ..... *B65D 5/14* (2013.01); *B31B 1/26* (2013.01); *B31B 17/00* (2013.01); *B65D 5/029* (2013.01); *B65D 5/0281* (2013.01)

(58) Field of Classification Search

CPC ..... B65D 5/14; B65D 5/029; B65D 5/0281; B31B 1/26; B31B 17/00

USPC ..... 229/109, 11, 122.33, 5.5, 5.8; 206/386, 206/600

See application file for complete search history.

(56) References Cited

U.S. PATENT DOCUMENTS

| | | | | |
|---|---|---|---|---|
| 3,023,919 A | | 3/1962 | Hobson | |
| 3,907,194 A | * | 9/1975 | Davenport | B65D 5/06 229/109 |
| 4,392,607 A | * | 7/1983 | Perkins, Jr. | B65D 5/10 229/109 |
| 4,762,226 A | * | 8/1988 | Gatton | B65D 5/4208 206/320 |
| 5,277,310 A | | 1/1994 | Mertz | |
| 5,307,928 A | | 5/1994 | Bishop | |
| 5,351,849 A | * | 10/1994 | Jagenburg | B65D 77/065 229/117.3 |
| 5,573,175 A | * | 11/1996 | Straub | B65D 5/10 220/DIG. 6 |

(Continued)

*Primary Examiner* — Gary Elkins
(74) *Attorney, Agent, or Firm* — WestRock IP Legal

(57) ABSTRACT

A blank assembly for forming a folded-cap container includes a first blank of sheet material that includes a pair of end panels, a pair of side panels, and a plurality of corner panels connected in series along a plurality of fold lines. Each of the end panels and side panels has a bottom edge that is substantially aligned with the respective bottom edges of the other end panels and side panels. Also, each of the four corner panels has a bottom free edge that is offset towards a central horizontal axis of the first blank from the bottom edges of the end panels and side panels. The blank assembly also includes a second blank of sheet material that includes a top panel and a lifting panel connected by a fold line. The top panel is configured to be coupled adjacent to a top edge of one of the end panels.

20 Claims, 14 Drawing Sheets

(56) References Cited

U.S. PATENT DOCUMENTS

| | | | | |
|---|---|---|---|---|
| 6,367,626 | B1 | 4/2002 | Muyskens | |
| 6,386,437 | B1 * | 5/2002 | Larson, Jr. | B65D 5/3621 229/109 |
| 6,446,859 | B1 * | 9/2002 | Holladay | B65D 5/10 229/109 |
| 6,688,514 | B2 * | 2/2004 | Evans | B65D 5/3621 229/109 |
| 7,228,965 | B2 | 6/2007 | Marventano et al. | |
| 7,368,159 | B2 | 5/2008 | Smith et al. | |
| 8,091,768 | B2 * | 1/2012 | Wisecarver | B65D 5/029 229/109 |

* cited by examiner

FOLDED-CAP CONTAINERS AND METHOD FOR MAKING SAME

CROSS REFERENCE TO RELATED APPLICATIONS

This application claims the benefit of U.S. Provisional Application No. 61/990,398, filed May 8, 2014, the disclosure of which is hereby incorporated by reference in its entirety.

BACKGROUND

This invention relates generally to folded-cap containers, and more specifically to methods for forming a folded-cap container from a blank of sheet material.

Containers fabricated from paperboard and/or corrugated paperboard material are often used to store and transport goods. Such containers are usually formed from blanks of sheet material that are folded along a plurality of preformed fold lines to form an erected corrugated container. At least some such containers are provided with folded caps that are configured to interface with a lifting blade of a forkless lift truck. One example of such a lifting blade for a lift truck is the LIFT-A-PLIANCE® system provided by the Basiloid Products Corp. of Elnora, Ind.

The folded caps are required to support a weight of the container, and the product contained within it, when the container is lifted by the lift truck. In addition, at least some such folded-cap containers are required to have compression strength sufficient to withstand an alternative side-clamp lifting method, wherein the container is lifted and transported using clamps applied to opposing sides of the container. At least some known folded-cap containers require internal bracing components, such as inserts formed from wood, to facilitate meeting such compression strength requirements. The internal bracing components typically are added within the container by hand after, and/or at the same time as, the product is packed in the container. Thus, the use of such internal bracing components increases both a materials cost and a labor cost of using such containers.

In addition, at least some such folded-cap containers are designed to receive a product attached to a pallet. More specifically, the product and four-sided pallet are slid inside the correspondingly four-sided container. The product and pallet are not secured or attached to the box, and the use of a four-sided container to slide over the four-sided pallet may limit a stacking strength of the container.

BRIEF DESCRIPTION OF THE DISCLOSURE

In one aspect, a blank assembly for forming a folded-cap container is provided. The blank assembly includes a first blank of sheet material that includes a pair of end panels, a pair of side panels, and a plurality of corner panels connected in series along a plurality of fold lines. Each of the pair of end panels and the pair of side panels has a bottom edge that is substantially aligned with the respective bottom edges of the others of the pair of end panels and the pair of side panels. Also, each of the four corner panels has a bottom free edge that is offset towards a central horizontal axis of the first blank from the bottom edges of the pair of end panels and the pair of side panels. The blank assembly also includes a second blank of sheet material that includes a top panel and a lifting panel connected by a fold line. The top panel is configured to be coupled adjacent to a top edge of one of the pair of end panels of the first blank.

In another aspect, a folded-cap container formed from a first blank of sheet material and a second blank of sheet material is provided. The folded-cap container includes a pair of end walls and a pair of side walls. Each of the pair of end walls and the pair of side walls includes at least one panel of the first blank, and each of the pair of end walls and the pair of side walls extends a first distance from a top end to a bottom end. The folded-cap container also includes a plurality of corner walls. Each corner wall includes at least one panel of the first blank, and each corner wall extends between one of the pair of end walls and one of the pair of side walls. In addition, each corner wall extends a second distance from the top end to a bottom free edge, and the second distance is shorter than the first distance. The folded-cap container further includes a top wall disposed proximate the top end that includes a top panel of the second blank, wherein a lifting panel extends from the top panel.

In another aspect, a method for forming a container from a first blank of sheet material and a second blank of sheet material is provided. The method includes rotating a pair of end panels, a pair of side panels, and a plurality of corner panels of the first blank about a plurality of fold lines to form a pair of end walls, a pair of side walls, and a plurality of corner walls. Each of the pair of end walls and the pair of side walls extends a first distance from a top end to a bottom end. Each corner wall extends a second distance from the top end to a bottom free edge, and the second distance is shorter than the first distance. The method also includes forming a top wall proximate the top end of the container. Forming the top wall includes coupling a top panel of the second blank to a top end panel of the first blank. A lifting panel extends from the top panel, and the top end panel extends from a top edge of one end panel of the pair of end panels. Forming the top wall also includes rotating the top end panel about a fold line at the top edge of the one end panel.

DETAILED DESCRIPTION OF THE DISCLOSURE

The folded-cap container and methods described herein overcome the limitations of known folded-cap containers. The folded-cap container and methods described herein include corner walls, forming an eight-sided container that facilitates an increased stacking strength of the container. The folded-cap container and methods described herein also include bottom panels that wrap around a base and miter corners that rest on the base, securing the container to the base, thereby securing the product contained within the container. The folded-cap container and methods described herein also include bottom panels and side walls that do not interfere with the base when the container is vertically removed from the base. Moreover, the folded-cap container and methods described herein provide compression strength sufficient for side-clamp lifting with fewer or no internal bracing components.

Figure 1:
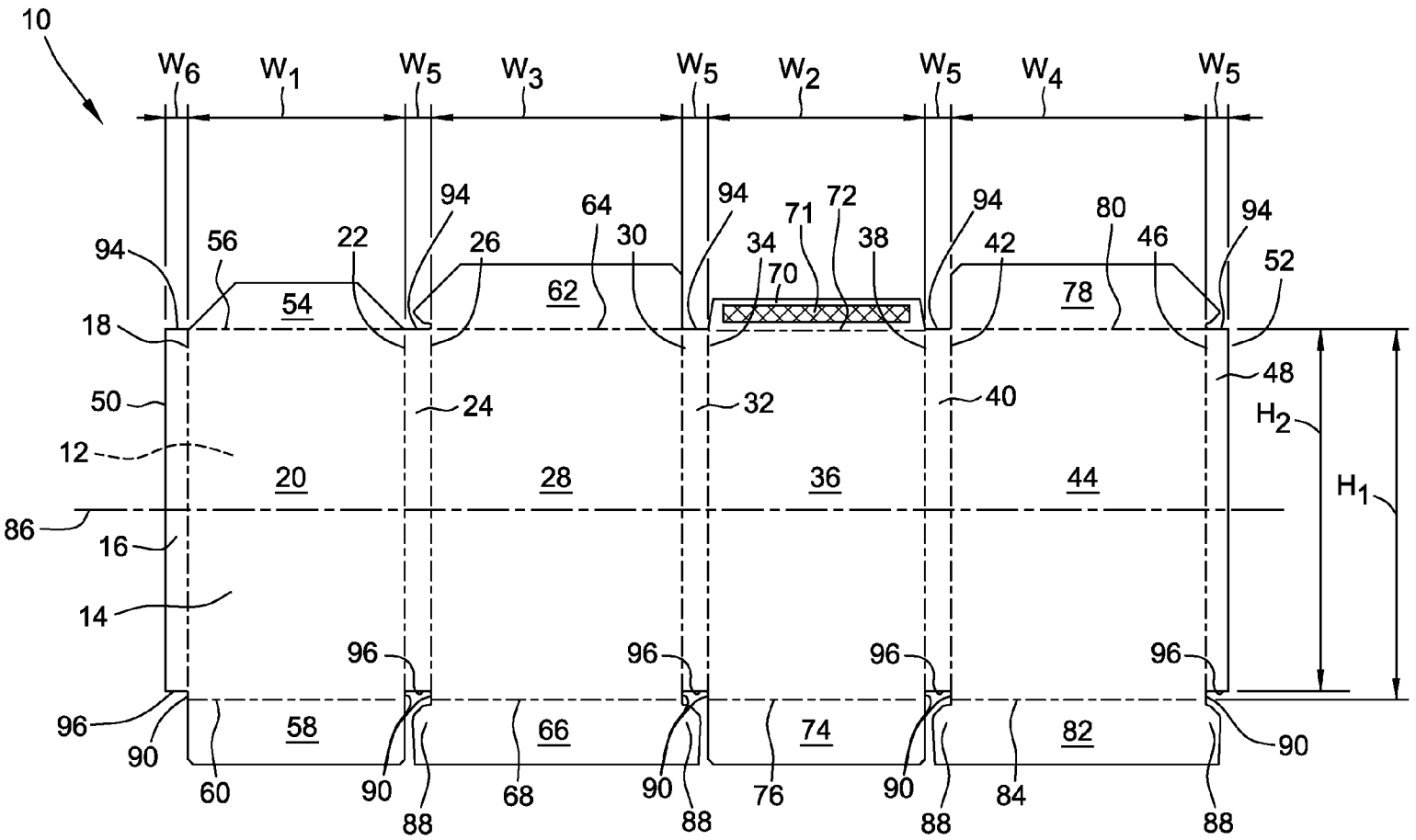
FIG. 1 is a top plan view of an example embodiment of a first blank of sheet material that may be used for forming an example folded-cap container shown in FIG. 4.
Figure 2:
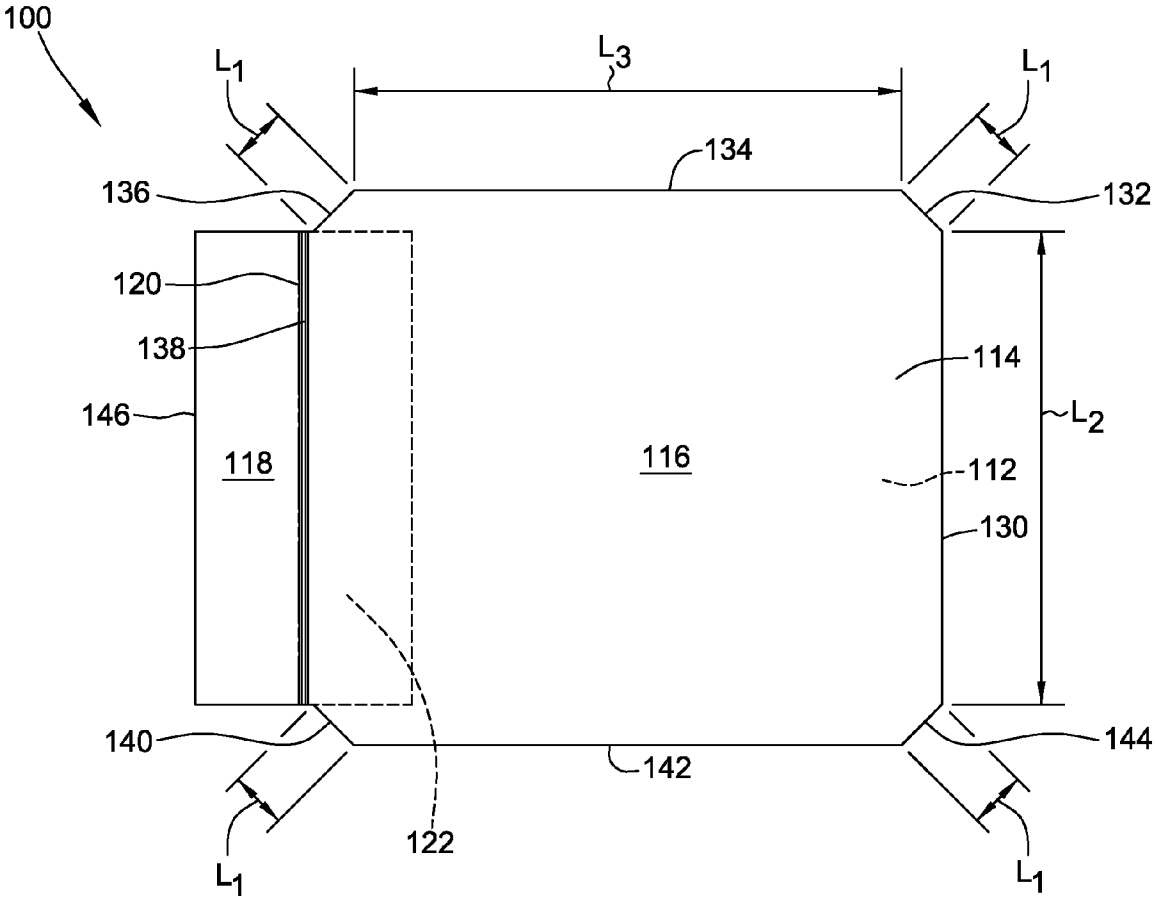
FIG. 2 is a top plan view of an example embodiment of a second blank of sheet material that may be used with the first blank shown in FIG. 1 for forming the example folded-cap container shown in FIG. 4.

FIG. 1 is a top plan view of an example embodiment of a substantially flat first blank 10 of sheet material, and FIG. 2 is a top plan view of a substantially flat second blank 100 of sheet material. With reference to FIG. 1 and FIG. 2, first blank 10 and second blank 100 may be referred to as a blank assembly. First blank 10 has an interior surface 12 and an exterior surface 14, and second blank 100 has an interior surface 112 and an exterior surface 114. In certain embodiments, portions of at least one of exterior surface 14 and interior surface 12 of first blank 10 and/or at least one of exterior surface 114 and interior surface 112 of second blank include 100 printed graphics, such as advertising and/or promotional materials. In an embodiment, first blank 10 is formed from a double-ply corrugated paperboard material to increase a stacking strength of a container 300 (shown in FIG. 4) formed from first blank 10 and second blank 100, and second blank 100 is formed from a triple-ply corrugated paperboard material to increase a compression strength of container 300. In alternative embodiments, first blank 10 and second blank 100 are each formed from any suitable material that enables container 300 to function as described herein.

With reference to FIG. 1, first blank 10 includes a plurality of aligned wall panels connected together by a plurality of preformed, generally parallel, fold lines. Specifically, the wall panels include a glue panel 16, a first end panel 20, also referred to as a rear end panel 20, a first corner panel 24, a first side panel 28, a second corner panel 32, a second end panel 36, also referred to as a front end panel 36, a third corner panel 40, a second side panel 44, and a fourth corner panel 48 connected in series along a plurality of parallel fold lines 18, 22, 26, 30, 34, 38, 42, and 46. Glue panel 16 extends from a first free edge 50 to fold line 18, first end panel 20 extends from glue panel 16 along fold line 18, first corner panel 24 extends from first end panel 20 along fold line 22, first side panel 28 extends from first corner panel 24 along fold line 26, second corner panel 32 extends from first side panel 28 along fold line 30, second end panel 36 extends from second corner panel 32 along fold line 34, third corner panel 40 extends from second end panel 36 along fold line 38, second side panel 44 extends from third corner panel 40 along fold line 42, and fourth corner panel 48 extends from second side panel 44 along fold line 46 and to a second free edge 52. Moreover, each of first corner panel 24, second corner panel 32, third corner panel 40, fourth corner panel 48, and glue panel 16 extends from a top free edge 94 to a bottom free edge 96.

A first top end panel 54 and a first bottom end panel 58 extend from opposing edges of first end panel 20 along a pair of opposing preformed, generally parallel, fold lines 56 and 60, respectively. Similarly, a first top side panel 62 and a first bottom side panel 66 extend from opposing edges of first side panel 28 along a pair of opposing preformed, generally parallel, fold lines 64 and 68, respectively. A second top end panel 70 and a second bottom end panel 74 extend from opposing edges of second end panel 36 along a pair of opposing preformed, generally parallel, fold lines 72 and 76, respectively. Similarly, a second top side panel 78 and a second bottom side panel 82 extend from opposing edges of second side panel 44 along a pair of opposing preformed, generally parallel, fold lines 80 and 84, respectively. Fold lines 56, 64, 72, and 80 are co-located with top edges of respective end and side panels 20, 28, 36, and 44, and fold lines 60, 68, 76, and 84 are co-located with bottom edges of respective end and side panels 20, 28, 36, and 44.

Fold lines 56, 60, 64, 68, 72, 76, 80, and 84 are generally perpendicular to fold lines 18, 22, 26, 30, 34, 38, 42, and 46. Fold lines 60, 68, 76, and 84 are substantially aligned. Fold lines 56, 64, and 80 also are substantially aligned. However, in the illustrated embodiment, fold line 72 is offset from fold lines 56, 64, and 80 towards a central horizontal axis 86 of first blank 10 to facilitate formation of a top wall 334 of container 300 (shown in FIG. 4) after coupling of exterior surface 14 of second top end panel 70 to interior surface 112 of second blank 100 (shown in FIG. 2). In an alternative embodiment, fold line 72 is offset from fold lines 56, 64, and 80 away from central horizontal axis 86 to facilitate formation of top wall 334 after coupling of interior surface 12 of second top end panel 70 to exterior surface 114 of second blank 100. In another alternative embodiment, fold line 56, rather than fold line 72, is offset towards central horizontal axis 86 to facilitate a coupling of exterior surface 14 of first top end panel 54 to interior surface 112 of second blank 100. In still other alternative embodiments, fold lines 56, 64, 72, and 80 are substantially aligned. Moreover, in the illustrated embodiment, a glue area 71 is disposed on exterior surface 14 of second top end panel 70 to facilitate coupling to second blank 100. In another alternative embodiment, glue area 71 is disposed on exterior surface 14 of first top end panel 54.

In an embodiment, first end panel 20 has a width $W_1$ taken along a central horizontal axis 86 of first blank 10 that is substantially equal to a width $W_2$ of second end panel 36 taken along central horizontal axis 86. Similarly, in an embodiment, first side panel 28 has a width $W_3$ taken along central horizontal axis 86 that is substantially equal to a width $W_4$ of second side panel 44 taken along central horizontal axis 86. In alternative embodiments, widths $W_1$ and $W_2$ may be unequal, and/or widths $W_3$ and $W_4$ may be unequal. Further, in an embodiment, each of first corner panel 24, second corner panel 32, third corner panel 40, and fourth corner panel 48 has a substantially equal width $W_5$. In alternative embodiments, at least one of first corner panel 24, second corner panel 32, third corner panel 40, and fourth corner panel 48 has a width that is not equal to a width of another of first corner panel 24, second corner panel 32, third corner panel 40, and fourth corner panel 48. In certain embodiments, glue panel 16 has a width $W_6$ that is less than or approximately equal to width $W_5$.

Additionally, in an embodiment, each of first end panel 20, first side panel 28, and second side panel 44 have a substantially equal height $H_1$ taken perpendicular to central horizontal axis 86. Second end panel 36 has a height that is slightly less than $H_1$, due to the offset of fold line 72 from fold lines 56, 64, and 80 as described above. In alternative embodiments where fold line 72 is not offset or is offset in the opposite direction, second end panel 36 has a height that is respectively equal to or slightly greater than $H_1$. Each of first corner panel 24, second corner panel 32, third corner panel 40, fourth corner panel 48, and glue panel 16 has a substantially equal height $H_2$ taken perpendicularly to central horizontal axis 86 that is less than height $H_1$. More specifically, bottom free edge 96 of each corner panel 24, 32, 40, and 48 and glue panel 16 is parallel to, and offset towards central horizontal axis 86 from, fold lines 60, 68, 76, and 84. In addition, top free edge 94 of each corner panel 24, 32, 40, and 48 and glue panel 16 is substantially aligned with fold lines 56, 64, and 80. In alternative embodiments, at least one of top free edge 94 and bottom free edge 96 of glue panel 16 is offset towards central horizontal axis 86 from fold lines 56, 64, and 80, and glue panel 16 correspondingly has a height that is less than height $H_2$.

Due to the offset of bottom free edges 96, each of first end panel 20, first side panel 28, second end panel 36, and second side panel 44 has a pair of oppositely disposed free edges 90 proximate to respective bottom panels 58, 66, 74, and 82. Oppositely disposed free edges 90 of first end panel 20 are substantially aligned with fold lines 18 and 22, respectively, oppositely disposed free edges 90 of first side panel 28 are substantially aligned with fold lines 26 and 30, respectively, oppositely disposed free edges 90 of second end panel 36 are substantially aligned with fold lines 34 and 38, respectively, and oppositely disposed free edges 90 of second side panel 44 are substantially aligned with fold lines 42 and 46, respectively. End and side panel free edges 90 are configured to facilitate wrapping bottom panels 58, 66, 74, and 82 about a base 200 (shown in FIG. 3) when container 300 (shown in FIG. 4) is formed.

In the illustrated embodiment, first bottom side panel 66 and second bottom side panel 82 each include a pair of oppositely disposed projections 88. Each projection 88 of first bottom side panel 66 extends parallel to central horizontal axis 86 such that a width of first bottom side panel 66 taken along central horizontal axis 86 is greater than width $W_3$ of first side panel 28, and each projection 88 of second bottom side panel 82 extends parallel to central horizontal axis 86 such that a width of second bottom side panel 82 taken along central horizontal axis 86 is greater than width $W_4$ of second side panel 44. In an alternative embodiment, first bottom end panel 58 and second bottom end panel 74 have projections 88, and first bottom side panel 66 and second bottom side panel 82 do not have projections 88. In another alternative embodiment, each of first bottom end panel 58, second bottom end panel 74, first bottom side panel 66, and second bottom side panel 82 have projections 88. In still another alternative embodiment, each of first bottom end panel 58, second bottom end panel 74, first bottom side panel 66, and second bottom side panel 82 do not have projections 88.

With reference to FIG. 2, second blank 100 includes a top panel 116 and a lifting panel 118 connected together by a preformed fold line 120. More specifically, lifting panel 118 extends from top panel 116 along fold line 120 to a free edge 146. Top panel 116 includes a first end edge 130, a first corner edge 132, a first side edge 134, a second corner edge 136, a second end edge 138 co-located with fold line 120, a third corner edge 140, a second side edge 142, and a fourth corner edge 144.

In certain embodiments, first corner edge 132, second corner edge 136, third corner edge 140, and fourth corner edge 144 each have a substantially equal length $L_1$. Moreover, in a particular embodiment, length $L_1$ is substantially equal to width $W_5$ of first corner panel 24, second corner panel 32, third corner panel 40, and fourth corner panel 48 of first blank 10 (shown in FIG. 1). In alternative embodiments, length $L_1$ is not substantially equal to width $W_5$. In other alternative embodiments, at least one of first corner edge 132, second corner edge 136, third corner edge 140, and fourth corner edge 144 has a length that is not equal to a length of another of first corner edge 132, second corner edge 136, third corner edge 140, and fourth corner edge 144.

Additionally, in certain embodiments, first end edge 130 and second end edge 138 each have a substantially equal length $L_2$, and length $L_2$ is substantially equal to width $W_1$ of first end panel 20 and width $W_2$ of second end panel 36 of first blank 10 (shown in FIG. 1). In alternative embodiments, length $L_2$ is not substantially equal to at least one of width $W_1$ and $W_2$. In other alternative embodiments, first end edge 130 has a length that is not equal to a length of second end edge 138. Similarly, in certain embodiments, first side edge 134 and second side edge 142 each have a substantially equal length $L_3$, and length $L_3$ is substantially equal to width $W_3$ of first side panel 28 and width $W_4$ of second side panel 44. In alternative embodiments, length $L_3$ is not substantially equal to at least one of width $W_3$ and $W_4$. In other alternative embodiments, first side edge 134 has a length that is not equal to a length of second side edge 142.

In the illustrated embodiment, a glue area 122 is disposed on top panel 116. More specifically, glue area 122 is located on interior surface 112 of top panel 116, adjacent to lifting panel 118. As will be described herein, glue area 122 is configured to be coupled to glue area 71 of second top end panel 70, such that second blank 100 is coupled to first blank 10 adjacent to a top edge of second end panel 36 defined by fold line 72. In an alternative embodiment, glue area 122 is configured to be coupled to first top end panel 54 adjacent to a top edge of first end panel 20 defined by fold line 56.

Figure 3:
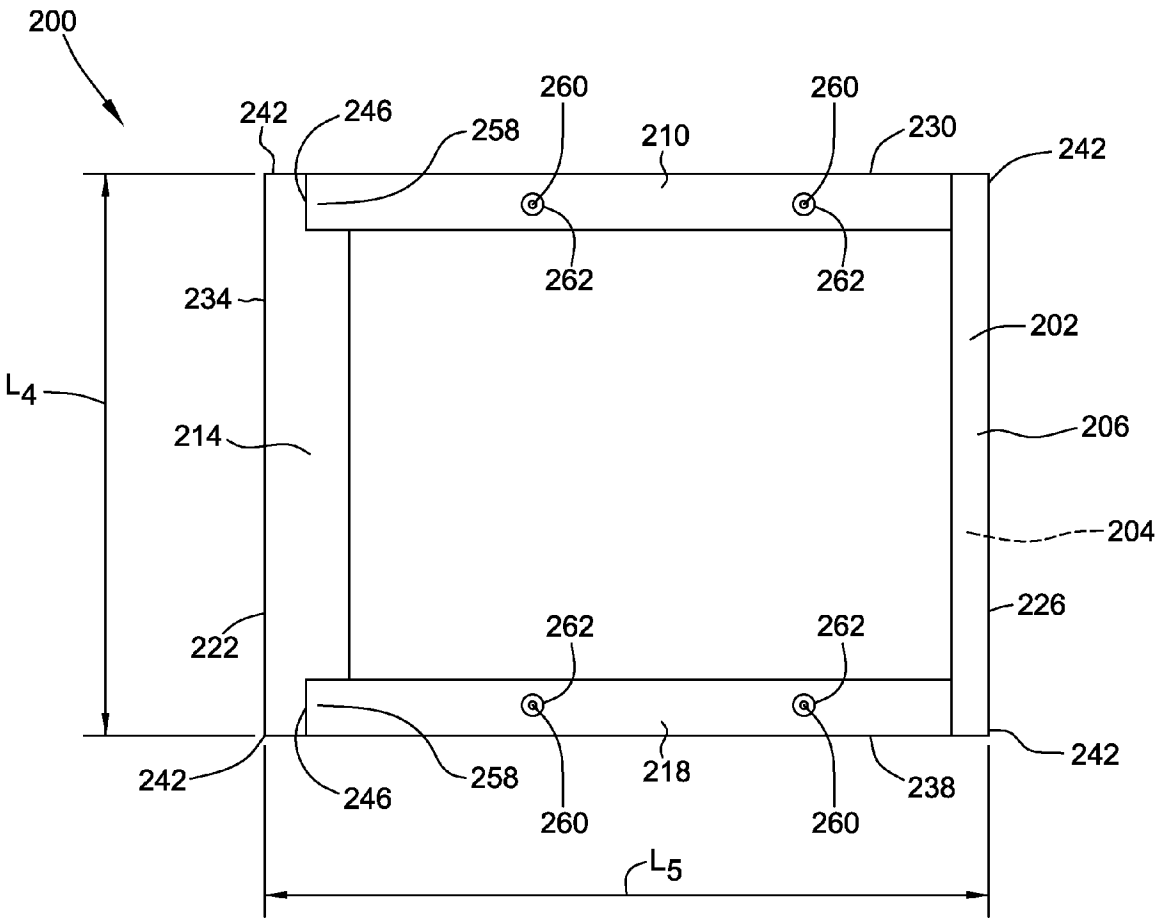
FIG. 3 is a schematic view of a bottom surface of an example embodiment of a base that may be used with the example folded-cap container shown in FIG. 4.
Figure 4:
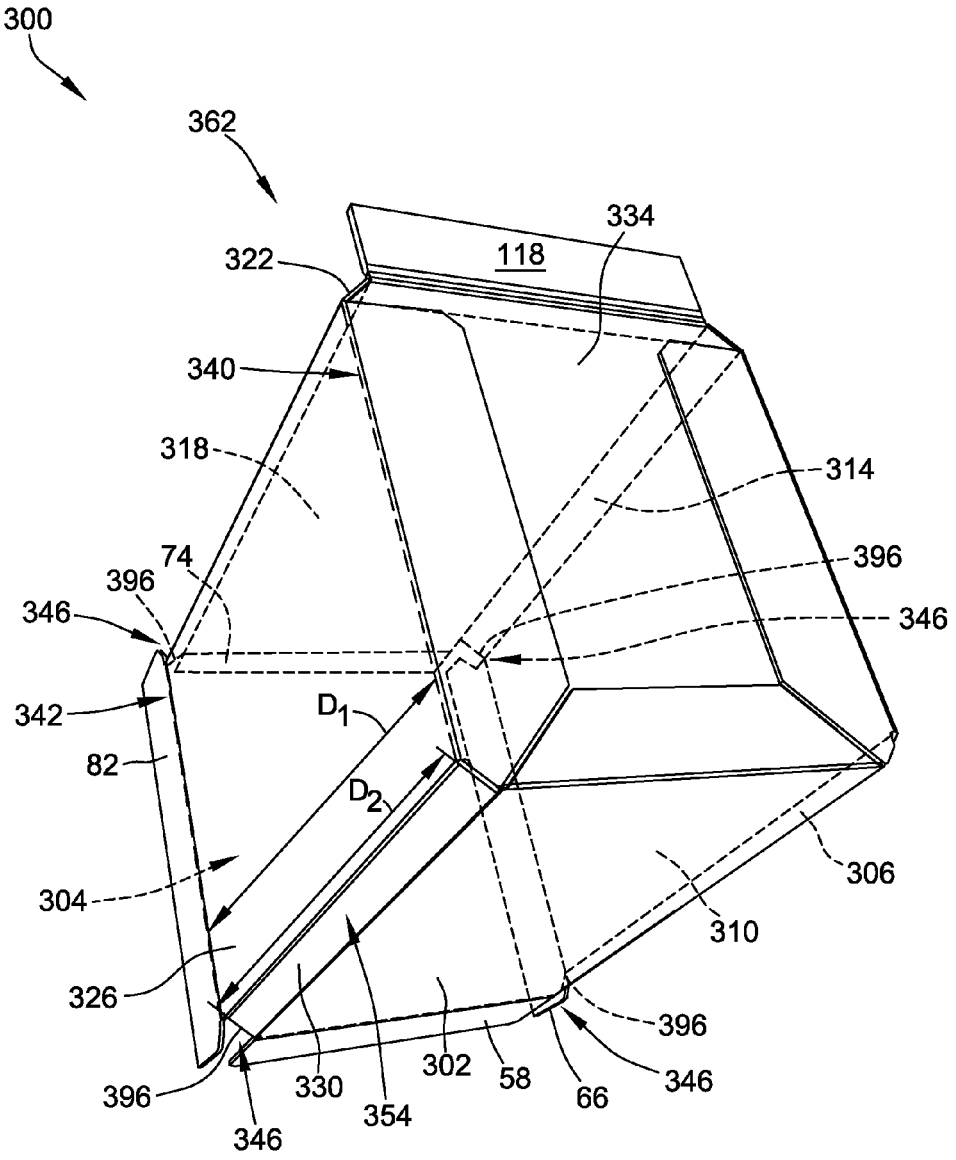
FIG. 4 is perspective view of an example embodiment of a folded-cap container that may be formed from the first blank shown in FIG. 1 and the second blank shown in FIG. 2, in an open-bottom configuration.

FIG. 3 is a schematic view of a bottom surface 202 of an embodiment of a base 200 that may be used with container 300 (shown in FIG. 4). Base 200 includes a first end member 206, a first side member 210, a second end member 214, and a second side member 218. First end member 206, first side member 210, second end member 214, and second side member 218 are coupled together to form a substantially rectangular perimeter 222. Perimeter 222 includes a first end edge 226, a first side edge 230, a second end edge 234, and a second side edge 238. Perimeter 222 also includes a plurality of corners 242. Each corner 242 is defined where one of first end edge 226 and second end edge 234 intersects with one of first side edge 230 and second side edge 238. Base 200 further includes a top surface 204 opposite bottom surface 202.

In an embodiment, first end edge 226 and second end edge 234 each have a substantially equal length $L_4$ that is greater than end panel widths $W_1$ and $W_2$ of first blank 10 (shown in FIG. 1). Similarly, first side edge 230 and second side edge 238 each have a substantially equal length $L_5$ that is greater than side panel widths $W_3$ and $W_4$ of first blank 10. Thus, corners 242 of base 200 are configured to extend through gaps in container 300 when container 300 is erected, as will be described herein.

In certain embodiments, first end member 206, first side member 210, second end member 214, and second side member 218 each are formed from wood. For example, each of first side member 210, second end member 214, and second side member 218 are cut from standard 1 inch by 2 inch lumber, and first end member 206 is cut from standard 1 inch by 1.5 inch lumber. Also in certain embodiments, each of first end member 206 and second end member 214 is coupled to each of first side member 210 and second side member 218 using wood staples. In alternative embodiments, first end member 206, first side member 210, second end member 214, and second side member 218 are formed from any suitable material, and are coupled together in any suitable fashion, that enables base 200 to function as described herein.

In the illustrated embodiment, second end member 214 includes a pair of oppositely disposed slots 246 each configured to receive an end portion 258 of first side member 210 and second side member 218, respectively. Slots 246 facilitate an increased compression strength and stability of base 200. Additionally or alternatively, slots 246 may be provided in at least one of first end member 206, first side member 210, and second side member 218. In other alternative embodiments, slots 246 are not included in any of first end member 206, first side member 210, second end member 214, and second side member 218.

Further in the illustrated embodiment, each of first side member 210 and second side member 218 includes a pair of holes 260 extending therethrough from bottom surface 202 to top surface 204. Each hole 260 is configured to receive one of a plurality of legs of a product (not shown), such as for example a dishwasher, to be packed in container 300 (shown in FIG. 4). In addition, each hole 260 is surrounded by an approximately circular inset portion 262 defined in bottom surface 202. Each inset portion 262 is configured to receive one of a plurality of feet that extends from a corresponding leg of the product to be packed in container 300. For example, the product may be packed in container 300 such that its legs extend through top surface 204 into holes 260, and the feet may then be inserted into inset portions 262 from bottom surface 202 and coupled to the legs. Additionally or alternatively, holes 260 and/or inset portions 262 may be provided in at least one of first side member 210 and second side member 218. In other alternative embodiments, base 200 does not include holes 260 and/or inset portions 262.

Figure 5:
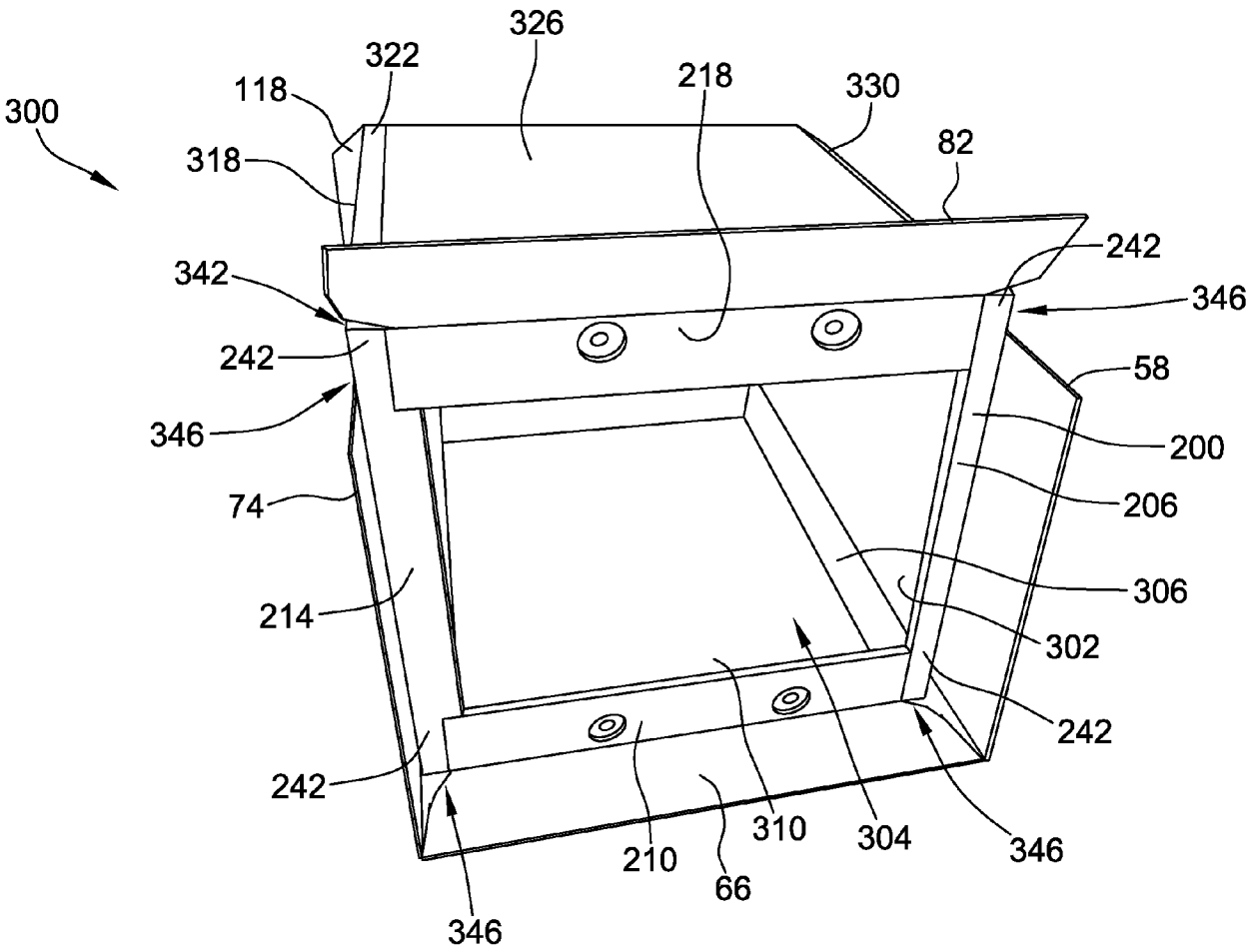
FIG. 5 is perspective view of the example folded-cap container shown in FIG. 4 with the base shown in FIG. 3 inserted.
Figure 6:
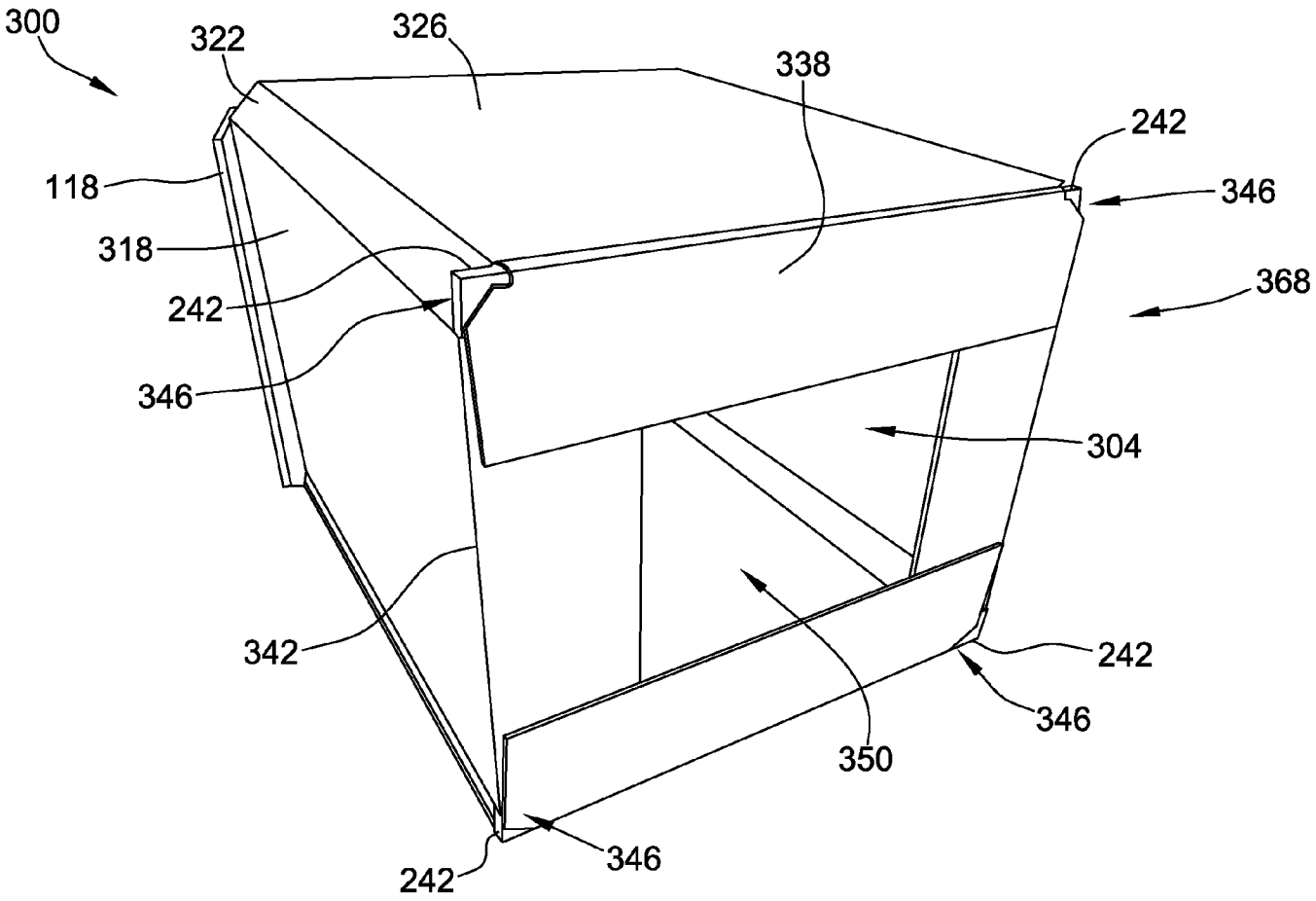
FIG. 6 is a perspective view of the example folded-cap container shown in FIG. 4 in a closed-bottom configuration with the container wrapped around and securing the base shown in FIG. 3.

As will be described below in more detail with reference to FIGS. 4-6, first blank 10, second blank 100, and base 200 are intended to form container 300 as shown in FIGS. 4-6 by coupling top panel 116 of second blank 100 (shown in FIG. 2) to one of second top end panel 70 and first top end panel 54 of first blank 10 (shown in FIG. 1), folding and/or securing glue panel 16, corner panels 24, 32, 40, and/or 48 of first blank 10, folding and/or securing top panel 116 of second blank 100 and top panels 54, 62, 70, and/or 78 of first blank 10, and folding and/or securing bottom panels 58, 66, 74, and/or 82 of first blank 10 about base 200. Of course, blanks having shapes, sizes, and configurations different from first blank 10 and second blank 100 described and illustrated herein may be used to form container 300 shown in FIGS. 4-6 without departing from the scope of the present disclosure.

FIG. 4 is perspective view of an embodiment of a folded-cap container 300 that may be formed from first blank 10 (shown in FIG. 1) and second blank 100 (shown in FIG. 2). More specifically, container 300 is illustrated in FIG. 4 in an open-bottom configuration 362. Container 300 includes a plurality of walls defining a cavity 304. More specifically, container 300 includes a first end wall 302, a first corner wall 306, a first side wall 310, a second corner wall 314, a second end wall 318, a third corner wall 322, a second side wall 326, a fourth corner wall 330, and a top wall 334. First end wall 302 includes first end panel 20 of first blank 10 (shown in FIG. 1), first corner wall 306 includes first corner panel 24, first side wall 310 includes first side panel 28, second corner wall 314 includes second corner panel 32, second end wall 318 includes second end panel 36, third corner wall 322 includes third corner panel 40, second side wall 326 includes second side panel 44, and fourth corner wall 330 includes fourth corner panel 48 and glue panel 16.

Further, top wall 334 includes first top end panel 54, first top side panel 62, second top end panel 70, and second top side panel 78 of first blank 10 and top panel 116 of second blank 100. More specifically, each of top panels 54, 62, 70, 78, and 116 are orientated generally perpendicular to each of walls 302, 306, 310, 314, 318, 322, 326, and 330 to form top wall 334. In the illustrated embodiment, exterior surface 14 of second top end panel 70 is coupled to glue area 122 of interior surface 112 of second blank 100, and interior surface 12 of each of top panels 54, 62, and 78 is coupled to exterior surface 114 of second blank 100. Lifting panel 118 emanates from an edge of top wall 334 adjacent to second end wall 318.

In certain embodiments, adhesive (not shown) is applied to interior surface 12 and/or exterior surface 14 at least one of glue panel 16 and fourth corner panel 48 to form fourth corner wall 330. Coupling glue panel 16 and fourth corner panel 48 forms a manufacturing joint 354. In addition, in certain embodiments, adhesive (not shown) is applied to interior surface 12 and/or exterior surface 14 of at least one of first top end panel 54, first top side panel 62, second top end panel 70, second top side panel 78, and top panel 116 to form top wall 334. In alternative embodiments, container 300 may be secured together using any suitable fastener at any suitable location on container 300.

Each of first end wall 302, first side wall 310, second end wall 318, and second side wall 326 extends from a top end 340 to a bottom end 342. In the illustrated embodiment, each of first end wall 302, first side wall 310, second end wall 318, and second side wall 326 has a substantially equal height. In alternative embodiments, any of first end wall 302, first side wall 310, second end wall 318, and second side wall 326 may have a height that differs from another of first end wall 302, first side wall 310, second end wall 318, and second side wall 326. Additionally, in the illustrated embodiment, end walls 302 and 318 are substantially parallel to each other, and side walls 310 and 326 are substantially parallel to each other. In alternative embodiments, end walls 302 and 318 are not substantially parallel to each other, and/or side walls 310 and 326 are not substantially parallel to each other.

In open-bottom configuration 362, uncoupled bottom panels 58, 66, 74, and 82 extend from bottom end 342. More specifically, uncoupled first bottom end panel 58 emanates from first end wall 302, uncoupled first bottom side panel 66 emanates from first side wall 310, uncoupled second bottom end panel 74 emanates from second end wall 318, and uncoupled second bottom side panel 82 emanates from second side wall 326 at bottom end 342. In addition, each of first corner wall 306, second corner wall 314, third corner wall 322, and fourth corner wall 330 extends from top end 340 towards bottom end 342. However, in the illustrated embodiment, because height $H_2$ of corner panels 24, 32, 40, and 48 of first blank 10 is less than height $H_1$ of side and end panels 20, 28, 36, and 48 of first blank 10 (as shown in FIG. 1), each corner wall 306, 314, 322, and 330 does not extend to bottom end 342, but instead terminates at a bottom free edge 396. In the illustrated embodiment, bottom free edge 396 of each corner wall 306, 314, 322, and 330 is formed by a corresponding bottom free edge 96 of corner panels 24, 32, 40, and 48 and glue panel 16 of first blank 10.

Bottom free edge 396 is a second distance $D_2$ from top end 340 that is shorter than a first distance $D_1$ from bottom end 342 to top end 340. As a result, a plurality of gaps 346 are defined proximate to bottom end 342. More specifically, gaps 346 are defined proximate to bottom end 342 between first end wall 302 and each of first side wall 310 and second side wall 326 and also between second end wall 318 and each of first side wall 310 and second side wall 326. Each gap 346 is at least partially defined by bottom free edge 96 of a respective one of corner panels 24, 32, 40, and corner panel 48 in combination with glue panel 16, free edge 90 of a respective one of side panels 28 and 44, and free edge 90 of a respective one of end panels 20 and 36 after first blank 10 (shown in FIG. 1) is erected into container 300. In alternative embodiments (not shown), at least one of corner wall 306, 314, 322, and 330 extends to bottom end 342, such that no corresponding gap is defined.

FIG. 5 is perspective view of an embodiment of folded-cap container 300 with base 200 inserted within cavity 304 proximate to bottom end 342. In the illustrated embodiment, base 200 is inserted proximate to bottom end 342 such that first end member 206 is generally adjacent to first end wall 302, first side member 210 is generally adjacent to first side wall 310, second end member 214 is generally adjacent to second end wall 318, and second side member 218 is generally adjacent to second side wall 326. Each corner 242 of base 200 extends through a corresponding gap 346 in container 300.

FIG. 6 is a perspective view of folded-cap container 300 in a closed-bottom configuration 368, with base 200 in cavity 304 proximate to a bottom wall 338 of container 300. Bottom wall 338 includes first bottom end panel 58, first bottom side panel 66, second bottom end panel 74 and second bottom side panel 82 of first blank 10 (shown in FIG. 1). More specifically, each of bottom panels 58, 66, 74, and 82 are orientated generally perpendicular to each of walls 302, 306, 310, 314, 318, 322, 326, and 330 to form bottom wall 338. Each corner 242 of base 200 extends through the corresponding gap 346 in container 300 after bottom wall 338 is formed. Moreover, each gap 346 is further defined by a respective one of bottom end panels 58 and 74 and a respective one of bottom side panels 66 and 82 (shown in FIG. 1). After bottom wall 338 is formed, gaps 346 facilitate securing base 200 to container 300. More specifically, gaps 346 capture corners 242 to reduce a movement of base 200 relative to container 300.

In addition, in the illustrated embodiment, each oppositely disposed projection 88 (shown in FIG. 1) of each of bottom side panels 66 and 82 extends approximately to a plane defined by a respective one of end walls 302 and 318. In alternative embodiments, bottom side panels 66 and 82 do not include projections 88. In certain embodiments, adhesive (not shown) is applied to interior surface 12 and/or exterior surface 14 of at least one of first bottom end panel 58, first bottom side panel 66, second bottom end panel 74 and second bottom side panel 82 to form bottom wall 338. In an embodiment, projections 88 increase an adhesive contact area between each of bottom side panels 66 and 82 and each of bottom end panels 58 and 74. In alternative embodiments, container 300 may be secured together using any suitable fastener at any suitable location on container 300.

In the illustrated embodiment, an opening 350 is defined within bottom wall 338, such that cavity 304 is accessible through bottom wall 338. In certain embodiments, a sealing element (not shown) may be disposed between a product (not shown) and base 200, and/or between base 200 and bottom wall 338, before or during a process in which the product is packed into container 300. In alternative embodiments, at least one of bottom end panels 58 and 74 and bottom side panels 66 and 82 extends to meet another of bottom end panels 58 and 74 and bottom side panels 66 and 82 when bottom wall 338 is formed, such that no opening is defined in bottom wall 338.

Referring to FIGS. 1-6, to construct container 300 from first blank 10 and second blank 100, glue panel 16 is rotated about fold line 18 toward interior surface 12 of first end panel 20, fourth corner panel 48 is rotated about fold line 46 toward interior surface 12 of second side panel 44, second side panel 44 is rotated about fold line 42 toward interior surface 12 of third corner panel 40, third corner panel 40 is rotated about fold line 38 toward interior surface 12 of second end panel 36, second end panel 36 is rotated about fold line 34 toward interior surface 12 of second corner panel 32, second corner panel 32 is rotated about fold line 30 toward interior surface 12 of first side panel 28, first side panel 28 is rotated about fold line 26 toward interior surface 12 of first corner panel 24, and first corner panel 24 is rotated about fold line 22 toward interior surface 12 of first end panel 20.

In an embodiment, after rotating panels 16, 20, 24, 28, 32, 36, 40, 44, and 48 about respective fold lines 18, 22, 26, 30, 34, 38, 42, and 46, end panels 20 and 36 are substantially parallel to each other and substantially perpendicular to side panels 28 and 44. Moreover, first and third corner panels 24 and 40 are substantially parallel to each other and substantially perpendicular to second and fourth corner panels 32 and 48. Glue panel 16 is coupled to fourth corner panel 48 to form manufacturing joint 354, as described above.

To form top wall 334, first top end panel 54 is rotated about fold line 56 toward interior surface 12 of first end panel 20, first top side panel 62 is rotated about fold line 64 toward interior surface 12 of first side panel 28, second top end panel 70 is rotated about fold line 72 toward interior surface 12 of second end panel 36, and second top side panel 78 is rotated about fold line 80 toward interior surface 12 of second side panel 44. Moreover, second blank 100 is coupled to one of first top end panel 54 and second top end panel 70. For example, in the illustrated embodiment, exterior surface 14 of second top end panel 70 is coupled to glue area 122 of interior surface 112 of top panel 116 of second blank 100, as described above. Second blank 100 may be coupled to one of first top end panel 54 and second top end panel 70 either before, during, or after the rotation of the one of first top end panel 54 and second top end panel 70. After the rotation of top panels 54, 62, 70, and 78 and the coupling of second blank 100, each of top end panels 54 and 70, top side panels 62 and 78, and top panel 116 is substantially perpendicular to each of walls 302, 306, 310, 314, 318, 322, 326, and 330.

In the illustrated embodiment, second top end panel 70 is rotated perpendicular to second end wall 318, and second blank 100 is coupled to second top end panel 70, before top side panels 62 and 78 and first top end panel 54 are rotated. Thus, top side panels 62 and 78 and first top end panel 54 are rotated such that their respective interior surfaces 12 are adjacent to exterior surface 114 of top panel 116. In alternative embodiments, at least one of top side panels 62 and 78 and first top end panel 54 may be rotated first, such that its respective exterior surface 14 is adjacent to interior surface 112 of top panel 116. Also in the illustrated embodiment, top side panels 62 and 78 and top end panels 54 and 70 are sized such that they do not overlap when top wall 334 is formed. In alternative embodiments, any of top side panels 62 and 78 and top end panels 54 and 70 may overlap when top wall 334 is formed. First top end panel 54, first top side panel 62, second top end panel 70, second top side panel 78, and top panel 116 are coupled together to form top wall 334, as described above.

Figure 7:
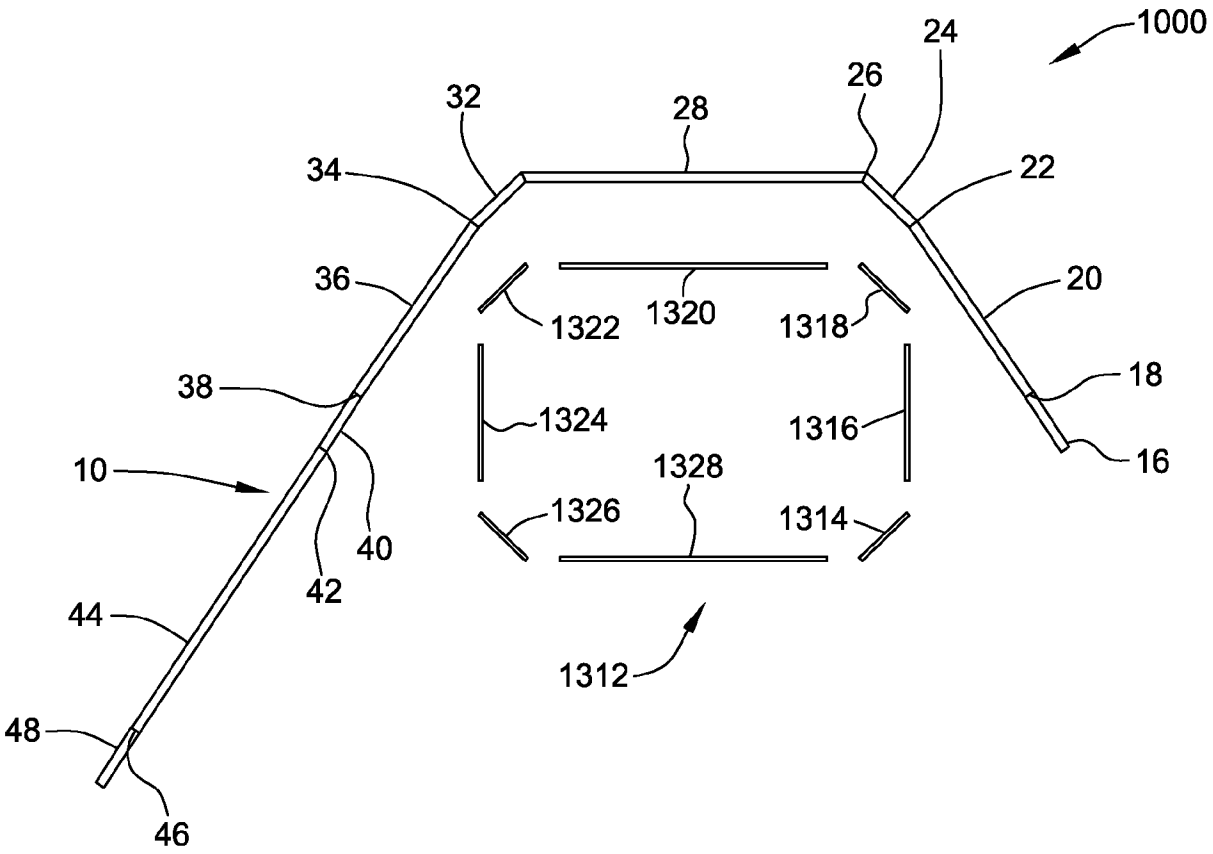
FIG. 7 is a schematic view of an example embodiment of a machine for wrapping the first blank shown in FIG. 1 about a mandrel to at least partially form the example folded-cap container shown in FIG. 4.

In a particular embodiment, container 300 is at least partially formed by a machine 1000, as illustrated in a schematic view in FIG. 7. More specifically, machine 1000 wraps at least first blank 10 about a mandrel 1312. With reference to FIGS. 1 and 7, mandrel 1312 includes a plurality of faces that substantially correspond to at least some of the panels on first blank 10. In the illustrated embodiment, mandrel 1312 includes a first corner face 1314, a first side face 1316, a second corner face 1318, a top face 1320, a third corner face 1322, a second side face 1324, a fourth corner face 1326, and a bottom face 1328. Corner faces, or miter faces, 1314, 1318, 1322, and 1326 each extend at an angle between bottom face 1328 and one of side faces 1316 and 1324, or between top face 1320 and one of side faces 1316 and 1324. Any of the mandrel faces can be solid plates, frames, plates including openings defined therein, and/or any other suitable component that provides a face and/or surface configured to enable a container to be formed from a blank as described herein. As discussed above, adhesive may be applied to interior surface 12 and/or exterior surface 14 of any suitable panel of first blank 10 to facilitate coupling of the panels by machine 1000. After adhesive is applied, first blank 10 is positioned adjacent to a face of mandrel 1312. In the illustrated embodiment, first side panel 28 is positioned above top face 1320 of mandrel 1312.

Machine 1000 includes various suitable assemblies (not shown) configured to wrap the panels of first blank 10 about the corresponding faces of mandrel 1312. For example, machine 1000 may include at least one of any of a lift assembly, a folding arm, a presser arm, an engaging bar, a plate-over tool, a squaring bar, a miter bar, and other suitable assemblies. Moreover, machine 1000 may be configured to drive these each of these assemblies independently or in any combination using at least one drive mechanism (not shown). For example, the at least one drive mechanism may include any of a mechanical linkage, a jack, a servomechanism, a rotary drive, a linear actuator, another suitable mechanism, or any combination thereof.

In the illustrated embodiment, machine 1000 presses first side panel 28 into substantially face-to-face contact with mandrel top face 1320. Machine 1000 also rotates second end panel 36 about fold line 34 into substantially face-to-face contact with mandrel second side face 1324 and rotates first end panel 20 about fold line 22 and into substantially face-to-face contact with mandrel first side face 1316. First corner panel 24 and second corner panel 32 also are pressed into substantially face-to-face contact with mandrel second corner face 1318 and mandrel third corner face 1322, respectively. Machine 1000 further rotates third corner panel 40 about fold line 38 into substantially face-to-face contact with mandrel fourth corner face 1326, and rotates second side panel 44 about fold line 42 into substantially face-to-face contact with mandrel bottom face 1328.

In an embodiment, machine 1000 further includes a glue panel folder plate and presser bar (not shown) that are movable generally towards and away from mandrel first corner face 1314. The folder plate rotates glue panel 16 about fold line 18 into substantially face-to-face contact with mandrel first corner face 1314, and the presser bar rotates fourth corner panel 48 about fold line 46 into substantially face-to-face contact with glue panel 16. In an alternative embodiment, the folder plate is configured to rotate fourth corner panel 48 into substantially face-to-face contact with mandrel first corner face 1314, and presser bar is configured to rotate glue panel 16 into substantially face-to-face contact with fourth corner panel 48. The presser bar also is configured to press fourth corner panel 48 and glue panel 16 together against mandrel first corner face 1314 to form manufacturing joint 354 at fourth corner wall 330 of container 300. Machine 1000 is configured to move folder plate and presser plate separately or in any combination, using any combination of suitable mechanisms. In certain embodiments, wrapping first blank 10 about mandrel 1312 to at least partially form container 300 facilitates an increased speed, consistency, and precision in forming container 300.

In an embodiment, second blank 100 is coupled to first blank 10 before first blank 10 is wrapped around mandrel 1312. For example, second blank 100 is coupled to second top end panel 70, and second blank 100 extends generally in front of second end panel 36 while first blank 10 is wrapped around mandrel 1312 as described above. In a particular embodiment, machine 1000 includes a top folder assembly (not shown) configured to fold first top end panel 54 about fold line 56, to fold second top end panel 70 and coupled top panel 116 of second blank 100 about fold line 72, to fold top side panels 62 and 78 about respective fold lines 64 and 80, and to press top panels 54, 62, 70, 78, and/or 116 together to form top wall 334 of container 300. In that particular embodiment, container 300 is ejected from machine 1000 in open-bottom configuration 362.

In alternative embodiments, second blank 100 is coupled to partially formed container 300 by machine 1000, by another machine, and/or by manual operation after manufacturing joint 354 is formed, and top wall 334 is then formed as described previously. Machine 1000 includes any suitable ejection mechanism for ejecting container 300 in one or more desired configurations.

With reference again to FIGS. 1-6, before forming bottom wall 338, base 200 is inserted into cavity 304 proximate to bottom end 342, as described above. In some embodiments, a product (not shown) to be packed within container 300, such as for example a dishwasher, is coupled to base 200, and container 300 in open-bottom configuration 362 is slid over the product and base 200 such that base 200 enters into cavity 304 proximate to bottom end 342. In alternative embodiments, the product is not coupled to base 200 when the product is packed within cavity 304, and base 200 is inserted into cavity 304 separately from the product being packed.

To form bottom wall 338, first bottom end panel 58 is rotated about fold line 60 toward interior surface 12 of first end panel 20, first bottom side panel 66 is rotated about fold line 68 toward interior surface 12 of first side panel 28, second bottom end panel 74 is rotated about fold line 76 toward interior surface 12 of second end panel 36, and second bottom side panel 82 is rotated about fold line 84 toward interior surface 12 of second side panel 44. After the rotation of bottom panels 58, 66, 74, and 82, each of bottom end panels 58 and 74 and bottom side panels 66 and 82 is substantially perpendicular to each of walls 302, 306, 310, 314, 318, 322, 326, and 330.

In the illustrated embodiment, each of bottom side panels 66 and 82 is rotated such that at least a portion of its interior surface 12 is adjacent to exterior surface 14 of each of bottom end panels 58 and 74. In an alternative embodiment, at least one of bottom end panels 58 and 74 is rotated such that at least a portion of its interior surface 12 is adjacent to exterior surface 14 of at least one of bottom side panels 66 and 82. In other alternative embodiments, bottom side panels 66 and 82 and bottom end panels 58 and 74 are sized such that they do not overlap when bottom wall 338 is formed. First bottom end panel 58, first bottom side panel 66, second bottom end panel 74, and second bottom side panel 82 are coupled together to form bottom wall 338, as described above.

After bottom wall 338 is formed, lifting panel 118 is configured to enable container 300 to be handled by a lifting blade of a forkless lift truck (not shown). More specifically, lifting panel 118 is secured against second end wall 318. In an embodiment, lifting panel 118 is taped to second corner wall 314 and first side wall 310 on one side, and taped to third corner wall 322 and second side wall 326 on the other side. In alternative embodiments, lifting panel 118 is taped to any suitable combination of corner walls 306, 314, 322, and 330, side walls 310 and 326, and first end wall 302. The lift truck may approach container 300 adjacent to second end wall 318 and slide the lifting blade up between lifting panel 118 and second wall 318. The lifting blade may then be used to lift container 300. Moreover, additional containers may be coupled to container 300 for simultaneous handling of multiple containers. In addition, in certain embodiments, container 300 is configured for alternative side-clamp lifting without a need to pack additional internal bracing components inside container 300. For example, top panel 116 of second blank 100 is formed from a triple-ply corrugated paperboard material to facilitate an increased compression strength of container 300.

In an embodiment, to remove the packed product from container 300, a user cuts through side walls 310 and 326, end walls 302 and 318, and optionally corner walls 306, 314, 322, and 330 at a location above base 200. The upper portion of container 300 may be slid vertically off of base 200 and over the product (not shown) to unpack the product. In an alternative embodiment, the user uncouples at least one of bottom panels 58, 66, 74, and 82 from another of bottom panels 58, 66, 74, and 82 to uncouple bottom wall 338. For example, the user may grab at least one interior edge of bottom wall 338 that defines opening 350 and pull apart a corresponding one of bottom panels 58, 66, 74, and 82 from bottom wall 338. Additionally or alternatively, the user may cut at least one of bottom panels 58, 66, 74, and 82 to separate bottom wall 338 from container 300.

Figure 8:
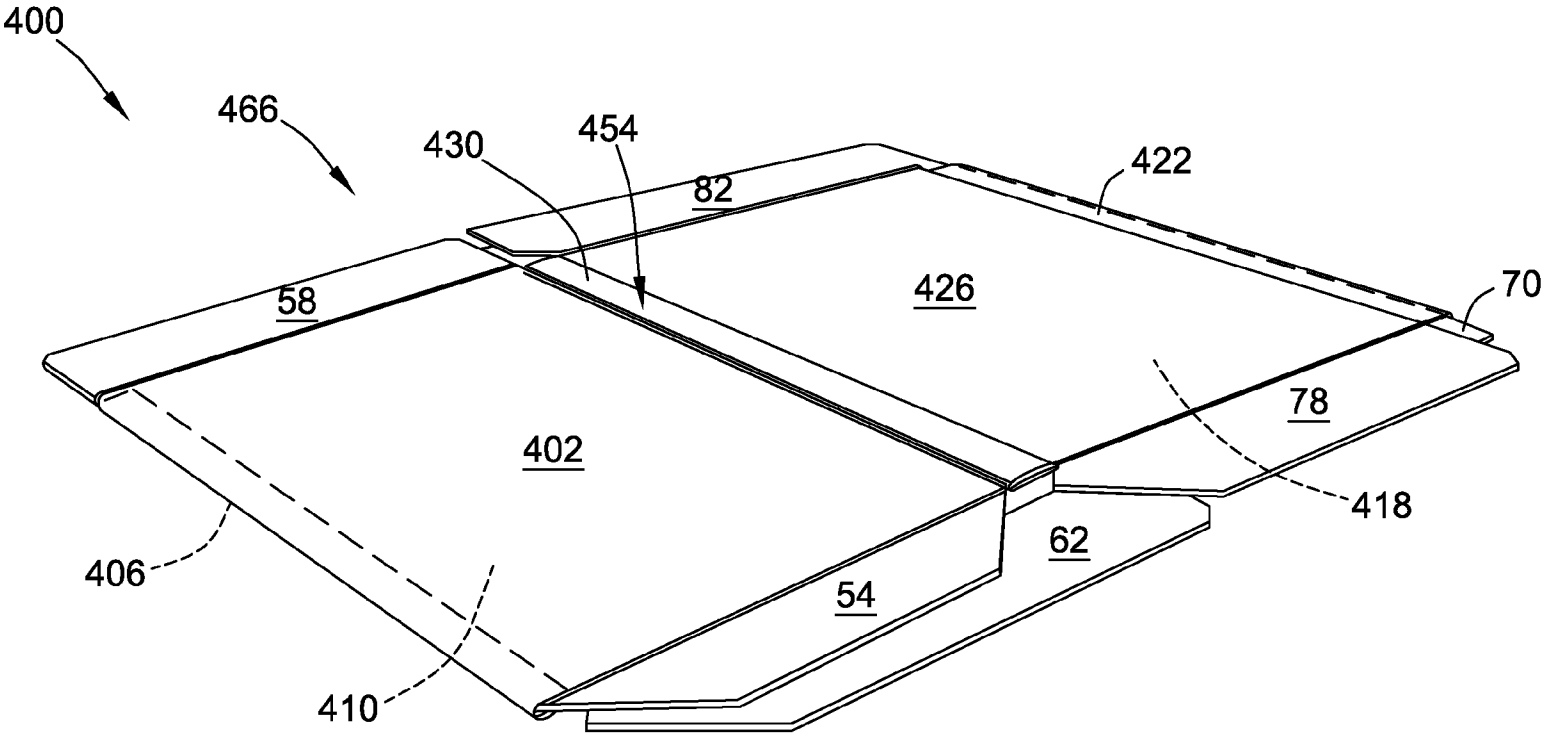
FIG. 8 is a perspective view of an alternative example embodiment of a folded-cap container that may be formed from the first blank shown in FIG. 1 in a knocked-down-flat configuration.
Figure 9:
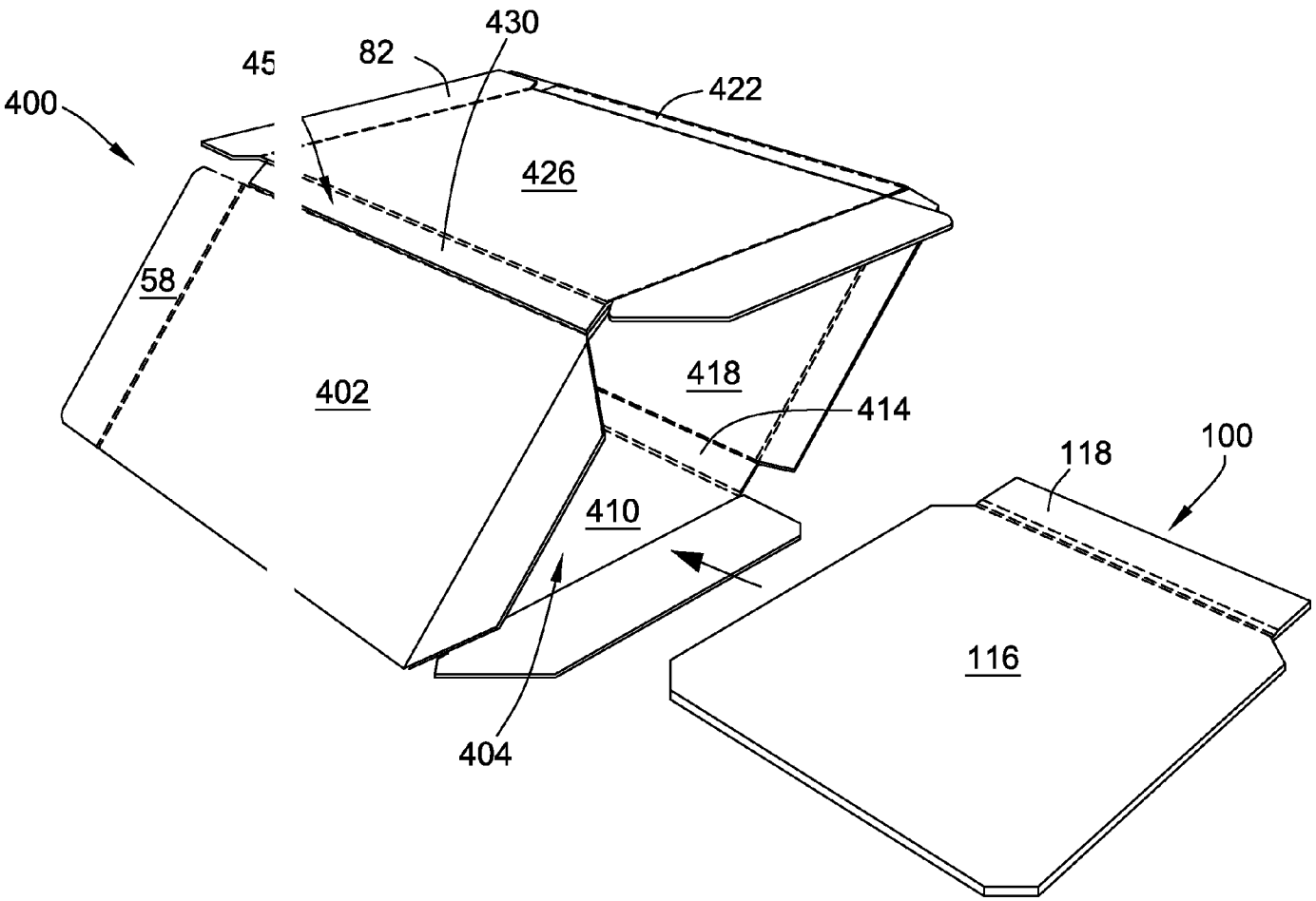
FIG. 9 is a perspective view of the second blank shown in FIG. 2 being inserted into the alternative example folded-cap container shown in FIG. 8 for shipping in the knocked-down-flat configuration shown in FIG. 8.
Figure 10:
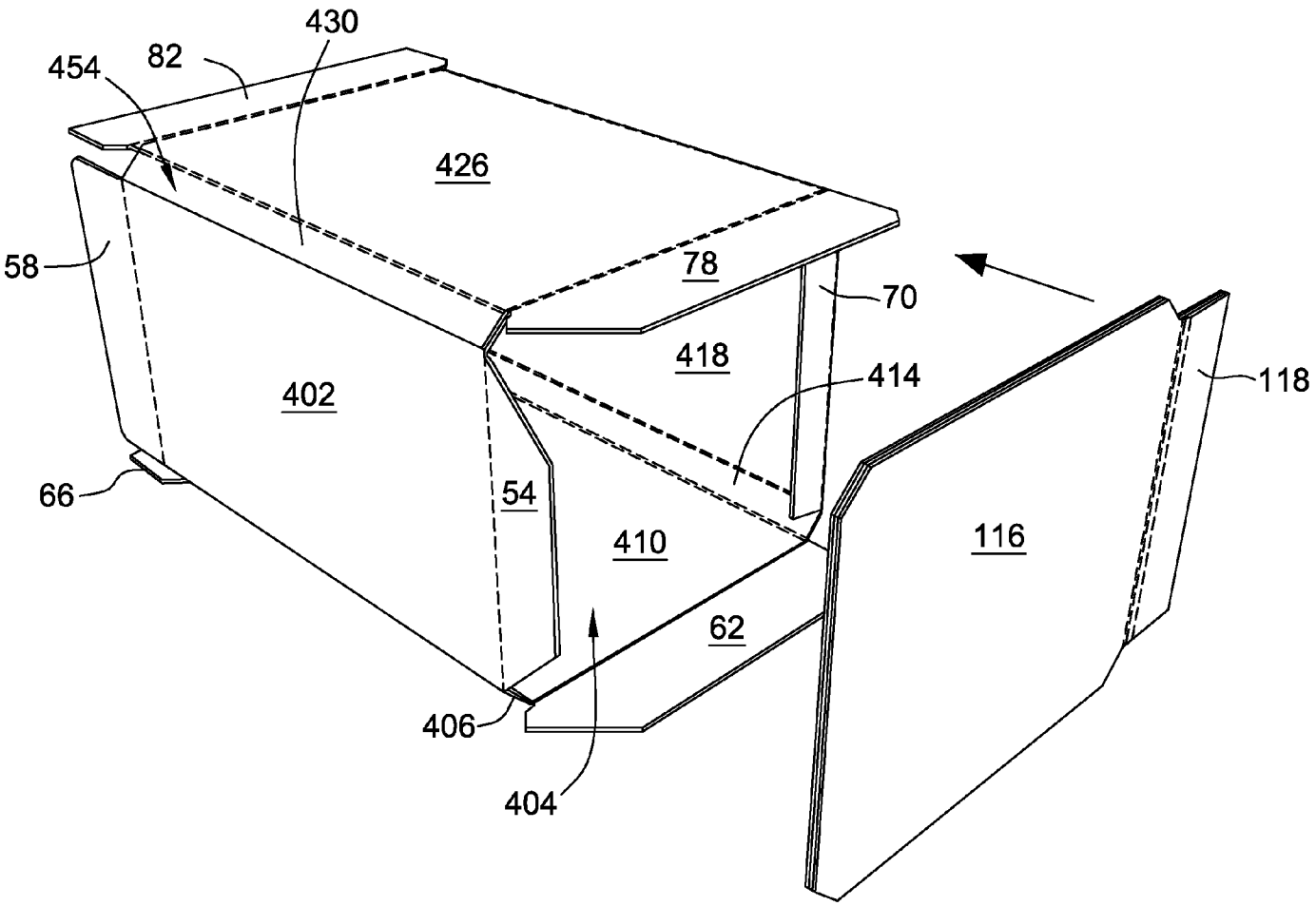
FIG. 10 is a perspective view of the second blank shown in FIG. 2 positioned for coupling to the alternative example folded-cap container shown in FIG. 8.

FIGS. 8-10 are perspective views of an alternative embodiment of a folded-cap container 400 that may be formed from first blank 10 and second blank 100. FIG. 8 illustrates container 400 in a partially formed configuration referred to as a knocked-down-flat configuration 466, FIG. 9 illustrates container 400 partially expanded from knocked-down-flat configuration 466, and FIG. 10 illustrates container 400 fully expanded from knocked-down-flat configuration 466 for coupling of second blank 100. With reference to FIGS. 1 and 8-10, container 400 is formed by coupling glue panel 16 to fourth corner panel 48 to form a manufacturing joint 454, similarly to forming manufacturing joint 354 of container 300 as described above.

More specifically, in an embodiment, first blank 10 is folded such that first end panel 20 is placed into a face-to-face relationship with at least a portion of interior surface 12 of first side panel 28, and folded such that second side panel 44 is placed into a face-to-face relationship with at least a portion of interior surface 12 of second end panel 36. For example, first end panel 20, along with glue panel 16, is first rotated about fold line 22 towards first side panel 28. Second side panel 44, along with third corner panel 40 and fourth corner panel 48, is then rotated about fold line 38 towards second end panel 36, placing exterior surface 14 of glue panel 16 into substantially face-to-face contact with interior surface 12 of fourth corner panel 48. Alternatively, second side panel 44 may be rotated first, such that interior surface 12 of glue panel 16 is placed into substantially face-to-face contact with exterior surface 14 of fourth corner panel 48. Glue panel 16 and fourth corner panel 48 are adhered using any suitable method to form manufacturing joint 454. In alternative embodiments, first blank 10 may be folded for formation of manufacturing joint 454 in any suitable fashion.

Similar to container 300, container 400 includes a plurality of walls defining a cavity 404. More specifically, container 400 includes a first end wall 402, a first corner wall 406, a first side wall 410, a second corner wall 414, a second end wall 418, a third corner wall 422, a second side wall 426, and a fourth corner wall 430. However, container 400 in knocked-down-flat configuration 466 has cavity 404 substantially collapsed, exterior surface 14 of first blank 10 substantially exposed, and interior surface 12 of first blank 10 only minimally exposed.

Container 400 may be shipped in knocked-down-flat configuration 466 to a customer facility for later erection into a fully formed configuration and for packaging of a product (not shown). In an embodiment illustrated in FIG. 9, prior to shipping container 400 in knocked-down-flat configuration 466, second side wall 426 may be pulled out of partial face-to-face contact with second end wall 418, for example by lifting second top side panel 78, second blank 100 may be inserted into cavity 404, and container 400 then may be re-flattened into knocked-down-flat configuration 466 and shipped to the customer facility with second blank 100 inside. At the customer facility, when partially formed container 400 is expanded from knocked-down-flat configuration 466, as illustrated in FIG. 10, second blank 100 is immediately available for coupling to container 400, thus facilitating an ease of erecting container 400 at the customer facility. The formation of container 400 may then be completed at the customer facility in a similar fashion as described above for container 300. In an embodiment, a machine (not shown) at the customer facility at least partially facilitates expansion of container 400 from knocked-down-flat configuration 466 and/or packaging of the product. In certain embodiments, shipping container 400 to the customer facility in knocked-down-flat configuration 466 facilitates a decreased logistical cost associated with a use of container 400.

Figure 11:
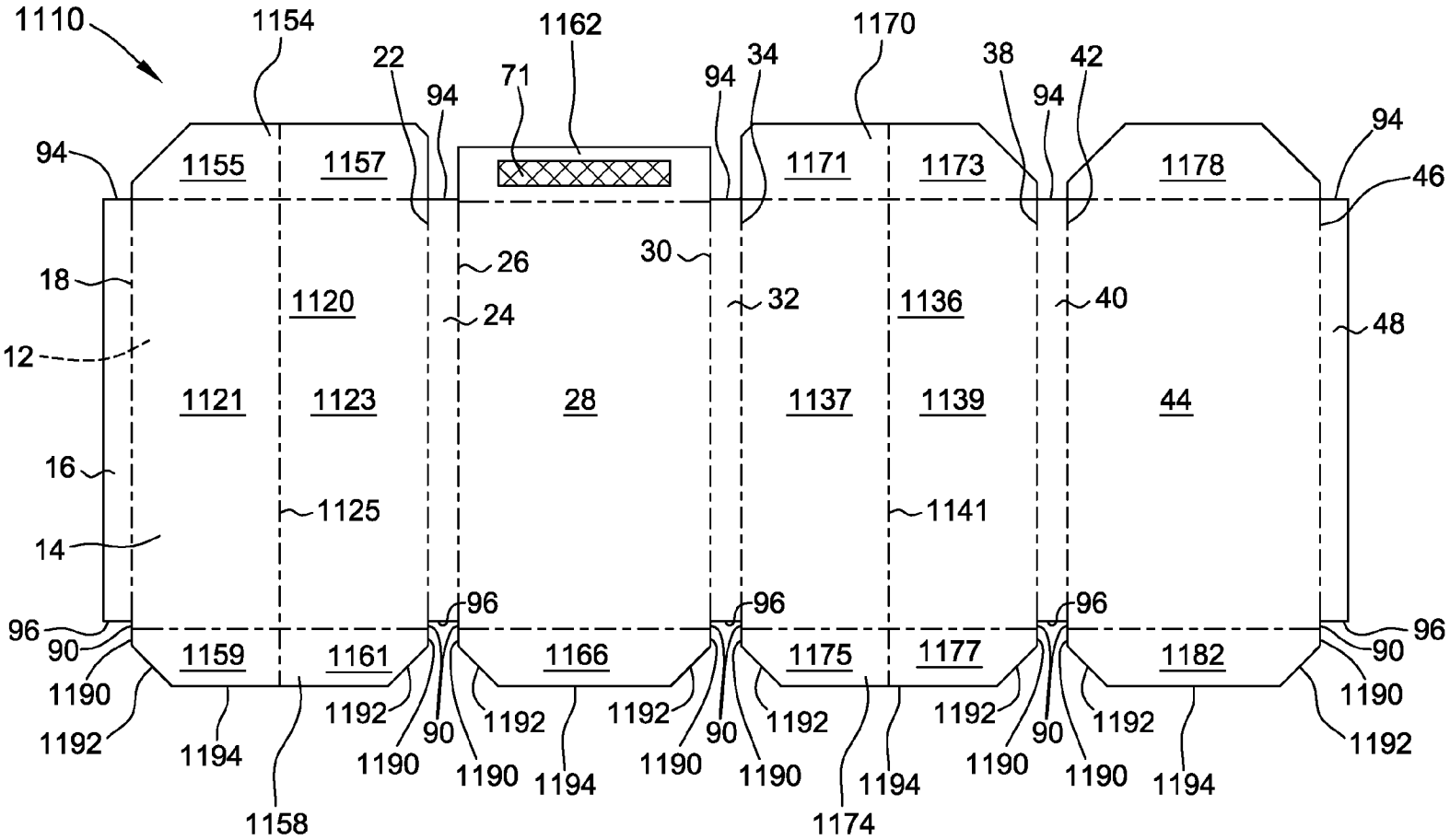
FIG. 11 is a top plan view of another example embodiment of a first blank of sheet material that may be used for forming an example folded-cap container shown partially formed in FIG. 12.
Figure 12:
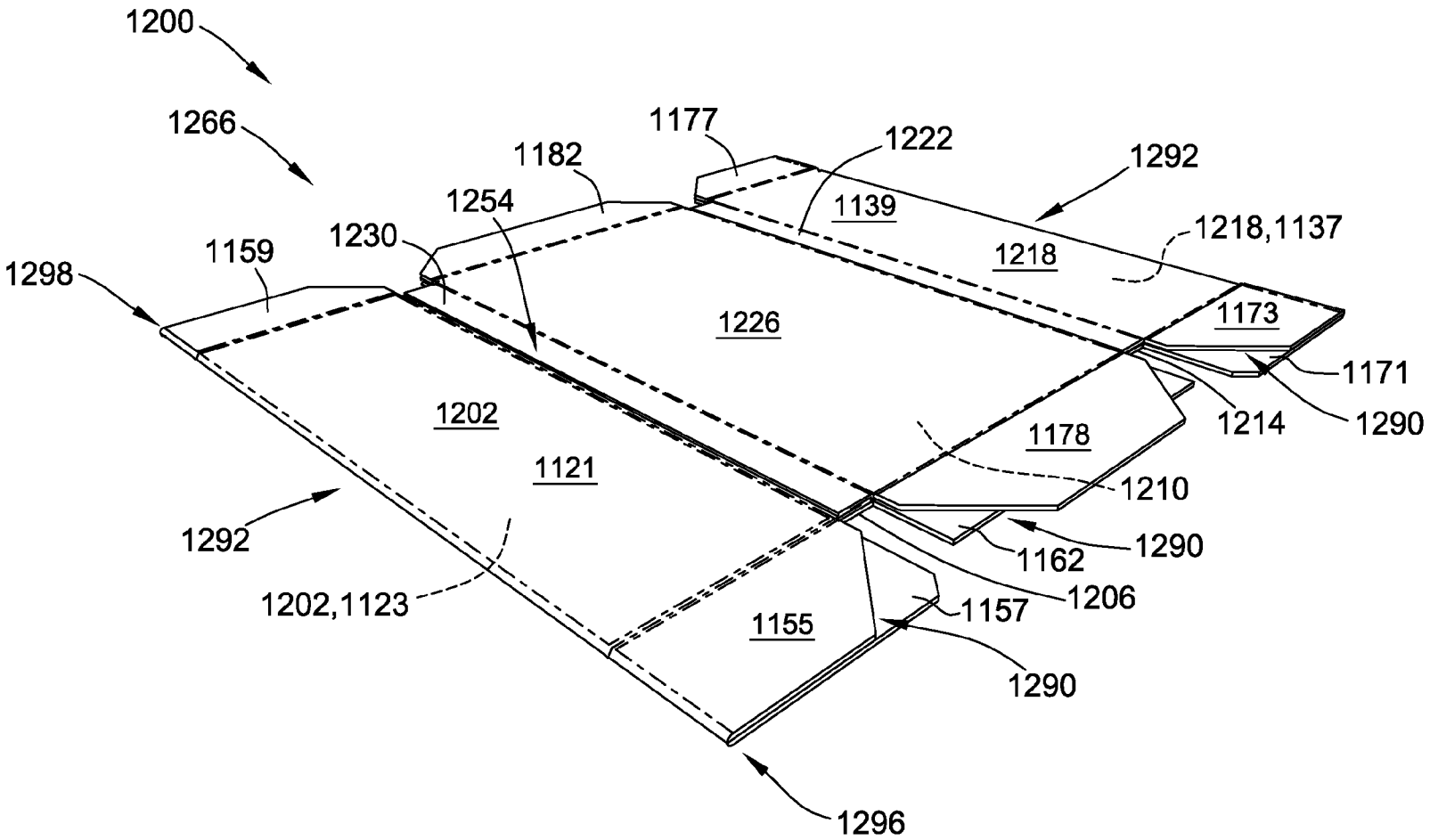
FIG. 12 is a perspective view of an example embodiment of a folded-cap container that may be formed from the first blank shown in FIG. 11 in a knocked-down-flat configuration.
Figure 13:
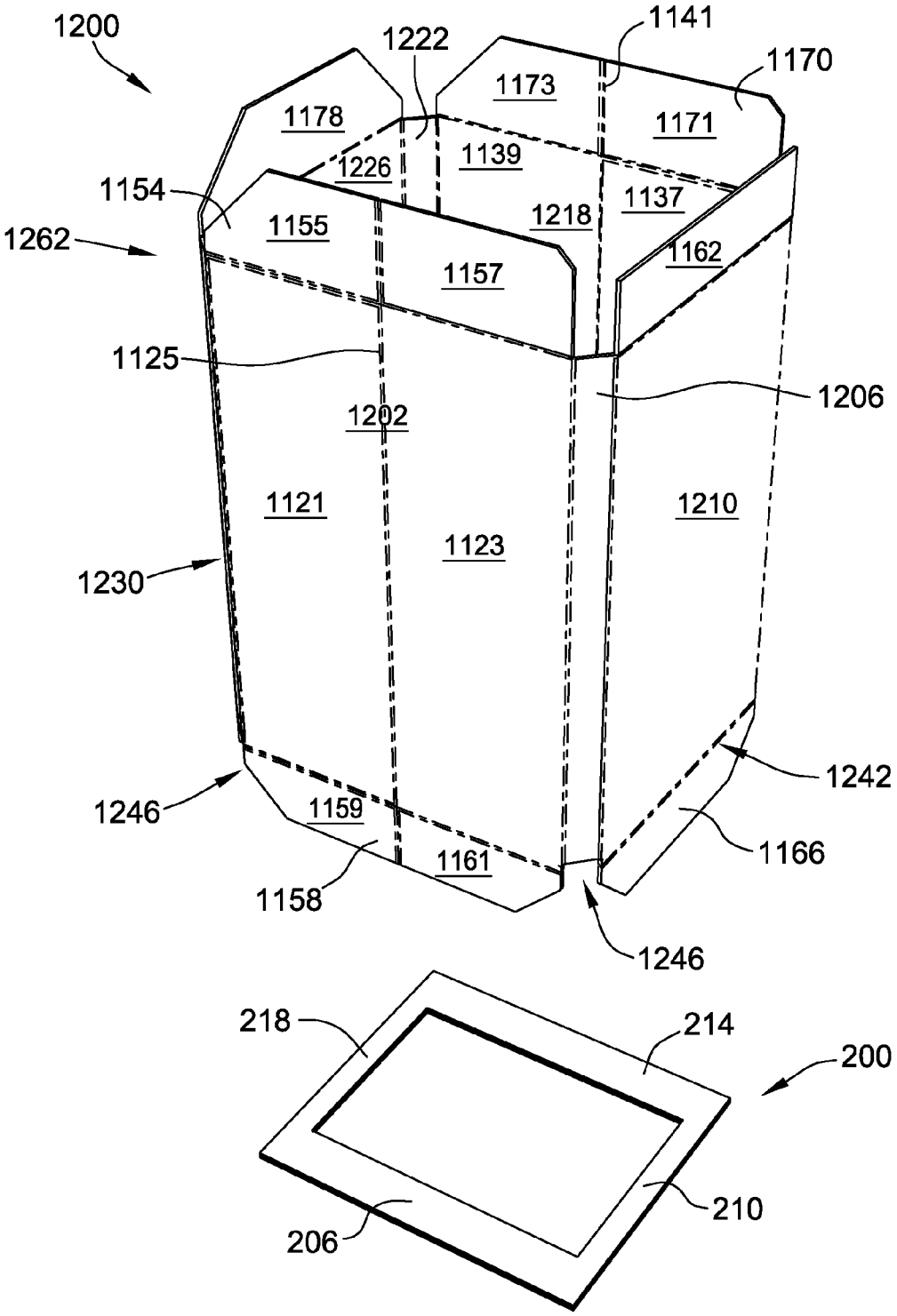
FIG. 13 is perspective view of the folded-cap container of FIG. 12 in an open-bottom configuration.
Figure 14:
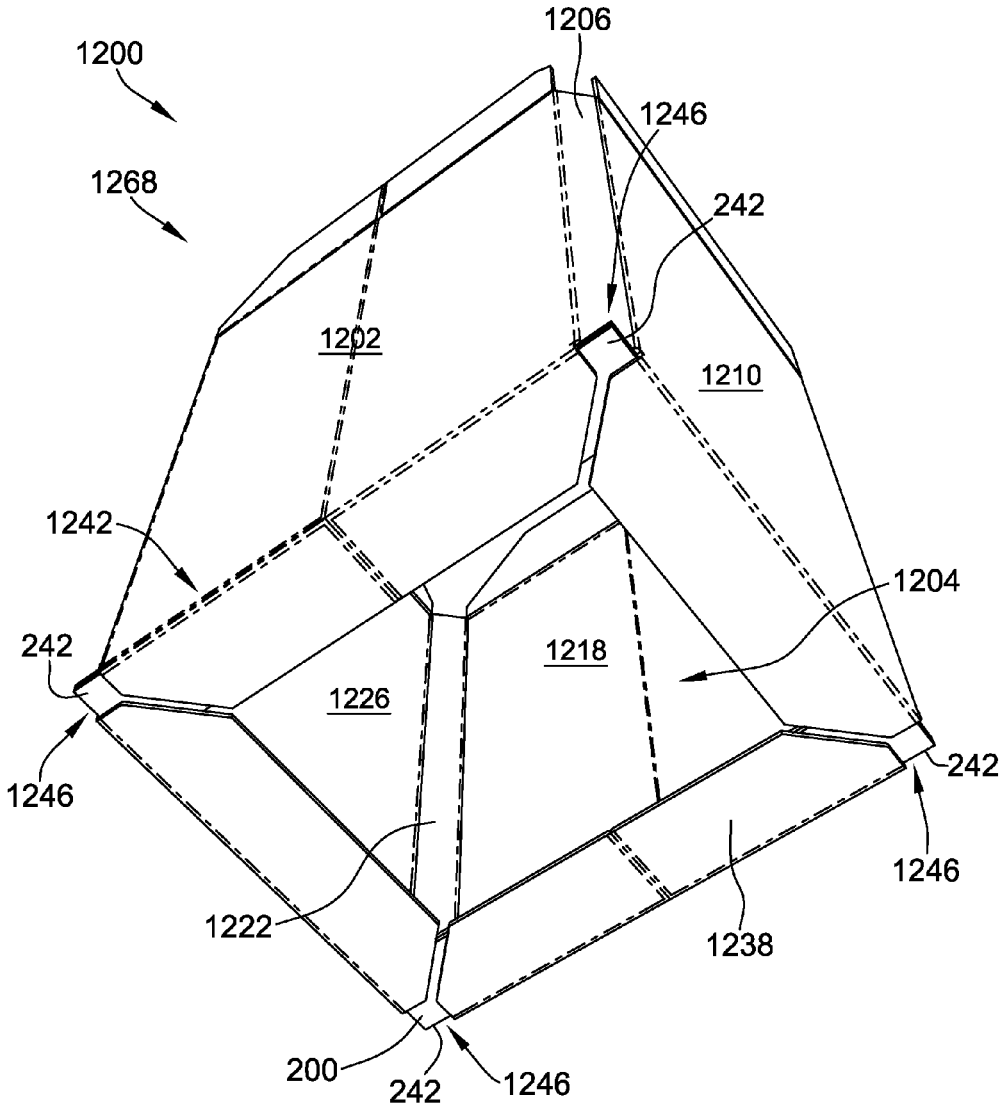
FIG. 14 is perspective view of the folded-cap container of FIG. 12 in a closed-bottom configuration.

FIG. 11 is a top plan view of another example embodiment of a substantially flat first blank 1110 of sheet material that can be used with second blank 100 (shown in FIG. 2) to form the blank assembly. FIG. 12 illustrates a folded-cap container 1200 formed from first blank 1110 and second blank 100 in a partially formed, knocked-down-flat configuration 1266. FIG. 13 illustrates container 1200 expanded into an open-bottom configuration 1262 defining a cavity 1204, and positioned to receive base 200 (shown in FIG. 3) in cavity 1204. FIG. 14 is a perspective view of container 1200 in a closed-bottom configuration 1268, with base 200 in cavity 1204 proximate to a bottom wall 1238 of container 1200.

First blank 1110 is substantially similar to first blank 10 (shown in FIG. 1) except as otherwise described below, and like features are numbered as in FIG. 1. In an embodiment, first blank 1110 is similarly formed from a double-ply corrugated paperboard material to increase a stacking strength of the container formed from first blank 1110 and second blank 100. In alternative embodiments, first blank 1110 is formed from any suitable material that enables container 1200 to function as described herein.

With reference to FIG. 11, first blank 1110 includes a first end panel 1120 that is separated into a first portion 1121 and a second portion 1123 by an intermediate fold line 1125. Similarly, first blank 1110 includes a second end panel 1136 that is separated into a first portion 1137 and a second portion 1139 by an intermediate fold line 1141. In the example embodiment, each of intermediate fold line 1125 and intermediate fold line 1141 is substantially parallel to fold lines 18, 22, 26, 30, 34, 38, 42, and 46. In alternative embodiments, at least one of intermediate fold line 1125 and intermediate fold line 1141 is other than substantially parallel to fold lines 18, 22, 26, 30, 34, 38, 42, and 46. In some embodiments, each of first end panel intermediate fold line 1125 and second end panel intermediate fold line 1141 facilitate automated formation of container 1200 from knocked-down-flat configuration 1266 into open-bottom configuration 1262 (shown in FIG. 13).

In addition, a first top end panel 1154 and a first bottom end panel 1158 extend from opposing edges of first end panel 1120, a first top side panel 1162 and a first bottom side panel 1166 extend from opposing edges of first side panel 28, a second top end panel 1170 and a second bottom end panel 1174 extend from opposing edges of second end panel 1136, and a second top side panel 1178 and a second bottom side panel 1182 extend from opposing edges of second side panel 44. Intermediate fold line 1125 extends through first top end panel 1154 and first bottom end panel 1158. More specifically, intermediate fold line 1125 separates first top end panel 1154 into a first portion 1155 and a second portion 1157, and separates first bottom end panel 1158 into first portion 1159 and second portion 1161. Similarly, intermediate fold line 1141 extends through second top end panel 1170 and second bottom end panel 1174. More specifically, intermediate fold line 1141 separates second top end panel 1170 into a first portion 1171 and a second portion 1173, and separates second bottom end panel 1174 into first portion 1175 and second portion 1177.

Similar to first blank 10, first blank 1110 includes end and side panel free edges 90 configured to facilitate wrapping bottom panels 1158, 1166, 1174, and 1182 about base 200 (shown in FIG. 3) when container 1200 is formed. However, in the example embodiment, each of bottom panels 1158, 1166, 1174, and 1182 has a different shape from corresponding bottom panels 58, 66, 74, and 82 of first blank 100 (shown in FIG. 1). In particular, each of bottom panels 1158, 1166, 1174, and 1182 includes a pair of opposing longitudinal edges 1190, and each longitudinal edge 1190 is aligned with a corresponding one of the pair of oppositely disposed free edges 90 of the side or end panel from which the bottom panel extends. More specifically, each bottom panel longitudinal edge 1190 extends from, and is substantially parallel to, the corresponding one of the pair of oppositely disposed free edges 90 of the side or end panel from which the bottom panel extends. Thus, none of bottom panels 1158, 1166, 1174, and 1182 includes projections 88 (shown in FIG. 1). In alternative embodiments, at least one of bottom panels 1158, 1166, 1174, and 1182 includes projections 88.

Moreover, in the example embodiment, each of bottom panels 1158, 1166, 1174, and 1182 includes a pair of opposing angled edges 1192 extending toward each other from longitudinal edges 1190, and a bottom edge 1194 extending between the pair of angled edges 1192. Angled edges 1192 are configured to prevent overlap among bottom panels 1158, 1166, 1174, and 1182 when bottom wall 1238 (shown in FIG. 14) of container 1200 is formed. In alternative embodiments, each of bottom panels 1158, 1166, 1174, and 1182 includes any suitable edge shape that enables container 1200 to be formed from blank 1110 as described herein.

Also in the example embodiment, each of top panels 1154, 1162, 1170, and 1178 has a different shape from corresponding top panels 54, 62, 70, and 78 of first blank 100 (shown in FIG. 1). In particular, first top end panel 1154 is asymmetric about intermediate fold line 1125, and second top end panel 1170 is asymmetric about intermediate fold line 1141. In some embodiments, the asymmetry of first top end panel 1154 and second top end panel 1170 facilitates automated separation of first top end panel first portion 1155 and first top end panel second portion 1157, and automated separation of second top end panel first portion 1171 and second top end panel second portion 1173, when container 1200 is transitioned from knocked-down-flat configuration 1266 into an erected, open bottom configuration similar to open-bottom configuration 362 of container 300 shown in FIG. 4. Similarly, in certain embodiments, first top side panel 1162 is not congruent with second top side panel 1178, facilitating automated separation of first top side panel 1162 and second top side panel 1178 when container 1200 is transitioned from knocked-down-flat configuration 1266 into the erected configuration. In alternative embodiments, each of top panels 1154, 1162, 1170, and 1178 has any suitable shape that enables container 1200 to be formed from blank 1110 as described herein.

In the illustrated embodiment, first blank 1110 includes glue area 71 disposed on exterior surface 14 of first top side panel 1162 to facilitate coupling to second blank 100. More specifically, glue area 122 on second blank 100 (shown in FIG. 2) is configured to be coupled to glue area 71, such that second blank 100 is coupled to first blank 10 adjacent to a top edge of first side panel 28. In an alternative embodiment, glue area 71 is disposed on exterior surface 14 of second top side panel 1178, and glue area 122 is configured to be coupled to second top side panel 1178 adjacent to a top edge of second side panel 44.

With reference to FIGS. 11-14, container 1200 in knocked-down-flat configuration 1266 is formed from first blank 1110 by coupling glue panel 16 to fourth corner panel 48 to form a manufacturing joint 1254, similarly to forming manufacturing joint 454 of container 400 (shown in FIGS. 8-10) as described above.

More specifically, in an embodiment, first portion 1121 of first end panel 1120, along with glue panel 16, is rotated about intermediate fold line 1125 of first end panel 1120 such that at least a portion of first portion 1121 of first end panel 1120 is placed into a face-to-face relationship with at least a portion of interior surface 12 of second portion 1123 of first end panel 1120. Second portion 1139 of second end panel 1136, along with third corner panel 40, second side panel 44, and fourth corner panel 48, is then rotated about intermediate fold line 1141 towards first side panel 28, placing exterior surface 14 of glue panel 16 into substantially face-to-face contact with interior surface 12 of fourth corner panel 48, and placing at least a portion of second portion 1139 of second end panel 1136 into a face-to-face relationship with at least a portion of interior surface 12 of first portion 1137 of second end panel 1136. Alternatively, first blank 1110 may be rotated about intermediate fold line 1141 first, such that interior surface 12 of glue panel 16 is placed into substantially face-to-face contact with exterior surface 14 of fourth corner panel 48. Glue panel 16 and fourth corner panel 48 are adhered using any suitable method to form manufacturing joint 1254. In alternative embodiments, first blank 1110 may be folded for formation of manufacturing joint 1254 in any suitable fashion.

Similar to container 400, container 1200 includes a first end wall 1202, a first corner wall 1206, a first side wall 1210, a second corner wall 1214, a second end wall 1218, a third corner wall 1222, a second side wall 1226, and a fourth corner wall 1230. First end wall 1202 includes first end panel 1120 of first blank 1110, first corner wall 1206 includes first corner panel 24, first side wall 1210 includes first side panel 28, second corner wall 1214 includes second corner panel 32, second end wall 1218 includes second end panel 1136, third corner wall 1222 includes third corner panel 40, second side wall 1226 includes second side panel 44, and fourth corner wall 1230 includes fourth corner panel 48 and glue panel 16.

Also similar to container 400, after container 1200 is expanded from knocked-down-flat configuration 1266 to open-bottom configuration 1262, each of end walls 1202 and 1218 are substantially planar, end walls 1202 and 1218 are substantially parallel to each other, and side walls 1210 and 1226 are substantially parallel to each other and substantially perpendicular to end walls 1202 and 1218. In alternative embodiments, end walls 1202 and 1218 are other than substantially planar and/or parallel to each other, and/or side walls 1210 and 1226 are other than substantially parallel to each other.

When container 1200 is fully erected, first end wall 1202, first corner wall 1206, first side wall 1210, second corner wall 1214, second end wall 1218, third corner wall 1222, second side wall 1226, and fourth corner wall 1230 cooperate to define cavity 1204. However, container 1200 in knocked-down-flat configuration 1266 has cavity 1204 substantially collapsed, exterior surface 14 of first blank 1110 substantially exposed, and interior surface 12 of first blank 1110 only minimally exposed. Moreover, container 1200 in knocked-down-flat configuration 1266 has first end wall 1202 collapsed upon itself, such that at least a portion of first portion 1121 of first end panel 1120 is placed into a face-to-face relationship with at least a portion of interior surface 12 of second portion 1123 of first end panel 1120, and has second end wall 1218 collapsed upon itself, such that at least a portion of second portion 1139 of second end panel 1136 is placed into a face-to-face relationship with at least a portion of interior surface 12 of first portion 1137 of second end panel 1136. It should be understood that second blank 100 may be inserted into the cavity and container 1200 then may be re-flattened into knocked-down-flat configuration 1266 for shipping to the customer facility with second blank 100 inside.

A plurality of gaps 1246, similar to gaps 346 of container 300 (shown in FIGS. 5 and 6), are defined proximate to a bottom end 1242 of container 1200. That is, each gap 1246 is at least partially defined by bottom free edge 96 of a respective one of corner panels 24, 32, 40, and corner panel 48 in combination with glue panel 16, free edge 90 of a respective one of side panels 28 and 44, and free edge 90 of a respective one of end panels 1120 and 1136 after first blank 1110 is erected into container 1200.

In the illustrated embodiment, base 200 is inserted proximate to bottom end 1242 such that first end member 206 is generally adjacent to first end wall 1202, first side member 210 is generally adjacent to first side wall 1210, second end member 214 is generally adjacent to second end wall 1218, and second side member 218 is generally adjacent to second side wall 1226. Each corner 242 of base 200 extends through a corresponding gap 1246 in container 1200.

Bottom wall 1238 includes first bottom end panel 1158, first bottom side panel 1166, second bottom end panel 1174 and second bottom side panel 1182 of first blank 1110. More specifically, each of bottom panels 1158, 1166, 1174, and 1182 are orientated generally perpendicular to each of walls 1202, 1206, 1210, 1214, 1218, 1222, 1226, and 1230 to form bottom wall 1238. Each corner 242 of base 200 extends through the corresponding gap 1246 in container 1200 after bottom wall 1238 is formed. After bottom wall 1238 is formed, gaps 1246 facilitate securing base 200 to container 1200. More specifically, gaps 1246 capture corners 242 to reduce a movement of base 200 relative to container 1200.

In certain embodiments, as described above, bottom panels 1158, 1166, 1174, and 1182 do not overlap when bottom wall 1238 is formed. Rather, each of first bottom end panel 1158, first bottom side panel 1166, second bottom end panel 1174, and second bottom side panel 1182 is securely coupled directly to base 200, rather than to another of first bottom end panel 1158, first bottom side panel 1166, second bottom end panel 1174, and second bottom side panel 1182, to form bottom wall 1238. For example, adhesive (not shown) is applied to bottom surface 202 of base 200 and/or interior surface 12 of each of first bottom end panel 1158, first bottom side panel 1166, second bottom end panel 1174 and second bottom side panel 1182 to form bottom wall 1238. Additionally or alternatively, each of first bottom end panel 1158, first bottom side panel 1166, second bottom end panel 1174, and second bottom side panel 1182 is stapled to base 200. In some embodiments, non-overlapping bottom panels 1158, 1166, 1174, and 1182 improve an integrity of base 200 and/or bottom wall 1238 when container 1200 is subjected to unplanned drop impacts. In alternative embodiments, bottom wall 1238 may be secured using any suitable fastener at any suitable location on container 1200.

Container 1200 may be formed in knocked-down-flat configuration 1266 in a manufacturing facility and shipped in knocked-down-flat configuration 1266 to a customer facility for later erection into a fully formed configuration and for packaging of a product (not shown). More specifically, container 1200 may be transitioned from knocked-down-flat configuration 1266 to open-bottom configuration 1262 in a manner similar to the erection of container 400 as shown in FIGS. 8-10.

As described above, at least one of the asymmetry of first top end panel 1154 about intermediate fold line 1125, the asymmetry of second top end panel 1170 about intermediate fold line 1141, and the incongruence of first top side panel 1162 and second top side panel 1178 facilitates expanding container 1200 from knocked-down-flat configuration 1266. More specifically, each of the asymmetry of first top end panel 1154 about intermediate fold line 1125, the asymmetry of second top end panel 1170 about intermediate fold line 1141, and the incongruence of first top side panel 1162 and second top side panel 1178 creates a discontinuity 1290 that facilitates mechanical separation of first and second portions 1155 and 1157 of first top end panel 1154, mechanical separation of first and second portions 1171 and 1173 of second top end panel 1170, and mechanical separation of first top side panel 1162 and second top side panel 1178, respectively, to expand container 1200 from knocked-down-flat configuration 1266.

Moreover, in the example embodiment, forming container 1200 by folding blank 1110 about intermediate fold lines 1125 and 1141 enables knocked-down-flat configuration 1266 to include substantially smooth, straight opposing outer side edges 1292 that each extend from a leading edge 1296 to a trailing edge 1298 of knocked-down-flat configuration 1266. In some embodiments, substantially smooth, straight outer side edges 1292 facilitate feeding knocked-down-flat configuration 1266 through a high-speed container forming machine (not shown) to expand container 1200 from knocked-down-flat configuration 1266 with increased speed, efficiency, and accuracy.

The example embodiments described herein provide a folded-cap container suitable for handling by a lifting blade of a forkless lift truck. The example embodiments provide a folded-cap container with corner walls forming an eight-sided container that facilitates an increased stacking strength of the container. The example embodiments also provide bottom panels that wrap around a base and corner walls that rest on the base such that the base, and additionally a product coupled to the base, are secured to the container. In addition, the example embodiments provide a folded-cap container having compression strength sufficient for alternative side-clamp lifting with few or no internal bracing components. The example embodiments also facilitate a machine process that includes wrapping at least a first blank about a mandrel to facilitate an increased speed, consistency, and precision in forming the folded-cap containers, and/or a process that produces folded-cap containers in a configuration that is suitable for shipping in a knocked-down flat configuration.

Example embodiments of a container and methods for forming a container from a blank are described above in detail. The container and methods are not limited to the specific embodiments described herein, but rather, components of systems and/or steps of the methods may be utilized independently and separately from other components and/or steps described herein. For example, the container may be made in other shapes and sizes from blanks of other shapes and sizes, and the machine may also be used in combination with other blanks and containers and is not limited to practice with only the blank and container described herein.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A blank assembly for forming a folded-cap container, said blank assembly comprising:

a first blank of sheet material comprising a pair of end panels, a pair of side panels, and a plurality of corner panels connected in series along a plurality of fold lines, wherein each of the pair of end panels and the pair of side panels has a bottom edge that is substantially aligned with the respective bottom edges of the others of the pair of end panels and the pair of side panels, and each of the four corner panels has a bottom free edge that is offset towards a central horizontal axis of the first blank from the bottom edges of the pair of end panels and the pair of side panels; and a second blank of sheet material comprising a top panel and a lifting panel connected by a fold line, wherein the top panel is configured to be coupled adjacent to a top edge of one of the pair of end panels of the first blank, and wherein the lifting panel is configured to be folded downward from the fold line and positioned against an outward facing surface of one of the pair of end panels of the first blank when the folded-cap container is formed.

2. The blank assembly in accordance with claim 1, wherein each panel of the pair of end panels and the pair of side panels has a pair of oppositely disposed free edges proximate to the bottom edge of the panel, each free edge is substantially aligned with one of the plurality of fold lines.

3. The blank assembly in accordance with claim 1, wherein the first blank further comprises a pair of bottom side panels each extending from the bottom edge of a respective one of the pair of side panels, each bottom side panel comprises a pair of oppositely disposed projections, each projection extends parallel to the central horizontal axis such that a width of each bottom side panel is greater than a width of the respective side panel.

4. The blank assembly in accordance with claim 1, wherein the first blank further comprises a top end panel extending from the top edge of the one of the pair of end panels, the top panel of the second blank is configured to be coupled to the top end panel.

5. The blank assembly in accordance with claim 4, wherein the first blank further comprises a pair of top side panels each extending from a top edge of a respective one of the pair of side panels, the top edges of the side panels are substantially aligned, the top edge of the one of the pair of end panels is offset from the top edges of the side panels.

6. The blank assembly in accordance with claim 1, wherein the top panel of the second blank includes a plurality of corner edges, a length of each corner edge is substantially equal to a width of each of the plurality of corner panels.

7. The blank assembly in accordance with claim 1, wherein the second blank is formed from a triple-ply corrugated paperboard material.

8. The blank assembly in accordance with claim 1, wherein the first blank is formed from a double-ply corrugated paperboard material.

9. A folded-cap container formed from a first blank of sheet material and a second blank of sheet material, the folded-cap container comprising:

a pair of end walls and a pair of side walls, each of the pair of end walls and the pair of side walls includes at least one panel of the first blank, each of the pair of end walls and the pair of side walls extends a first distance from a top end to a bottom end; a plurality of corner walls, each corner wall includes at least one panel of the first blank, each corner wall extends between one of the pair of end walls and one of the pair of side walls, each corner wall extends a second distance from the top end to a bottom free edge, wherein the second distance is shorter than the first distance; and a top wall disposed proximate the top end that includes a top panel of the second blank, wherein a lifting panel extends from the top panel and is folded downward over a top end of one of the pair of end walls and against an outward facing surface of said end wall.

10. The folded-cap container in accordance with claim 9, further comprising a plurality of gaps defined proximate to the bottom end, each gap is defined between one of the pair of end walls and one of the pair of side walls.

11. The folded-cap container in accordance with claim 10, wherein each gap is at least partially defined by a bottom free edge of one of a plurality of corner panels of the first blank, a free edge of one of a pair of side panels of the first blank, and a free edge of one of a pair of end panels of the first blank.

12. The folded-cap container in accordance with claim 9, wherein the pair of end walls, pair of side walls, and plurality of corner walls define a cavity, the folded-cap container further comprises a base inserted within the cavity proximate to the bottom end.

13. The folded-cap container in accordance with claim 12, wherein the base includes a plurality of corners, each corner extends through a corresponding one of a plurality of gaps, each gap is defined proximate to the bottom end between one of the pair of end walls and one of the pair of side walls.

14. The folded-cap container in accordance with claim 13, further comprising a bottom wall formed from a plurality of bottom panels, each bottom panel emanates from one wall of the pair of end walls and the pair of side walls, each gap is further defined by a respective one of the bottom panels emanating from the pair of end walls and a respective one of the bottom panels emanating from the pair of side walls.

15. The folded-cap container in accordance with claim 9, wherein one of the pair of end walls includes one end panel of a pair of end panels of the first blank, a top end panel extends from the one end panel, the top panel of the second blank is coupled to the top end panel.

16. A method for forming a container from a first blank of sheet material and a second blank of sheet material, the method comprising:

rotating a pair of end panels, a pair of side panels, and a plurality of corner panels of the first blank about a plurality of fold lines to form a pair of end walls, a pair of side walls, and a plurality of corner walls, wherein each of the pair of end walls and the pair of side walls extends a first distance from a top end to a bottom end, each corner wall extends a second distance from the top end to a bottom free edge, and the second distance is shorter than the first distance; and forming a top wall proximate the top end of the container by: coupling a top panel of the second blank to a top end panel of the first blank, wherein a lifting panel extends from the top panel, and wherein the top end panel extends from a top edge of one end panel of the pair of end panels; and rotating the top end panel about a fold line at the top edge of the one end panel.

17. The method in accordance with claim 16, wherein the pair of end walls, the pair of side walls, and the plurality of corner walls define a cavity, the method further comprises inserting a base within the cavity proximate to the bottom end.

18. The method in accordance with claim 17, wherein the base includes a plurality of corners, and inserting the base within the cavity comprises inserting the base such that each corner extends through a corresponding one of a plurality of gaps, each gap is defined proximate to the bottom end between one of the pair of end walls and one of the pair of side walls.

19. The method in accordance with claim 16, wherein rotating the pair of end panels, the pair of side panels, and the plurality of corner panels of the first blank comprises wrapping the pair of end panels, the pair of side panels, and the plurality of corner panels about a mandrel to form the pair of end walls, the pair of side walls, and the plurality of corner walls.

20. The method in accordance with claim 16, wherein the pair of end walls, the pair of side walls, and the plurality of corner walls define a cavity, the method further comprising: forming the pair of end walls, the pair of side walls, and the plurality of corner walls in a knocked-down-flat configuration; and inserting the second blank into the cavity.

* * * * *